United States Patent [19]

Sequeira, Jr. et al.

[11] 4,162,197

[45] Jul. 24, 1979

[54] FURFURAL REFINING UNIT CONTROL SYSTEM

[75] Inventors: Avilino Sequeira, Jr.; John D. Begnaud; Frank L. Barger, all of Port Arthur, Tex.

[73] Assignee: Texaco Inc., New York, N.Y.

[21] Appl. No.: 912,909

[22] Filed: Jun. 5, 1978

Related U.S. Application Data

[63] Continuation of Ser. No. 851,999, Nov. 16, 1977, abandoned.

[51] Int. Cl.[2] ..... C10G 21/00; C06G 7/58

[52] U.S. Cl. ..... 196/14.52; 23/230 A; 364/497; 364/501

[58] Field of Search ..... 196/14.52; 23/253 A, 23/230 A; 364/497, 501

[56] References Cited

U.S. PATENT DOCUMENTS

| | | | |
|---|---|---|---|
| 3,799,871 | 3/1974 | Sequeira, Jr. | 196/14.52 |
| 3,911,259 | 10/1975 | Huddleston et al. | 364/501 |
| 3,972,779 | 3/1976 | Harrison | 196/14.52 |
| 4,053,744 | 10/1977 | Woodle | 196/14.52 |

*Primary Examiner*—R. E. Serwin

*Attorney, Agent, or Firm*—Thomas H. Whaley; Carl G. Ries; Ronald G. Gillespie

[57] ABSTRACT

A system controls a furfural refining unit in which the furfural refining unit includes an extractor receiving furfural and charge oil, one of which is at a predetermined flow rate while the other flow rate is to be controlled and providing raffinate and extract mix. The control system includes sensors sensing the flow rate, the gravity, the viscosity, the flash point temperature, the refractive index and the sulfur content of the charge oil. Other sensors sense the flow rate of the furfural and the temperature of the extract mix. The signals from the sensors are provided to control apparatus which controls the other flow rate of the charge oil and the furfural flow rates in accordance with the signals from the sensors.

15 Claims, 24 Drawing Figures

FURFURAL REFINING UNIT CONTROL SYSTEM

CROSS REFERENCE TO RELATED APPLICATIONS

This application is a continuation as to all subject matter common to U.S. application Ser. No. 851,999 filed Nov. 16, 1977, now abandoned, by Avilino Sequeira, Jr., John D. Begnaud and Frank L. Barger, and assigned to Texaco Inc., assignee of the present invention, and a continuation-in-part for additional subject matter.

BACKGROUND OF THE INVENTION

The present invention relates to control systems in general and, more particularly, to control systems for oil refining units.

SUMMARY OF THE INVENTION

A furfural refining unit treats charge oil with a furfural in an extractor which provides raffinate and extract mix. The furfural is recovered from the raffinate and from the extract mix and returned to the extractor. A system controlling the refining unit includes a gravity analyzer, a flash point temperature analyzer, viscosity analyzers, a refractive index analyzer and a sulfur content analyzer. The analyzers analyze the charge oil and provide corresponding signals. Flow rate sensors sense the flow rates of the charge oil and the furfural entering the extractor and provide flow rate signals. One of the flow rates of the charge oil and the furfural flow rate is a constant flow rate while the other flow rate is controllable. The controllable flow rate is controlled in accordance with the signals provided by all the sensors and the analyzers.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustrative purposes only and are not to be construed as defining the limits of the invention.

DESCRIPTION OF THE INVENTION

Figure 1:
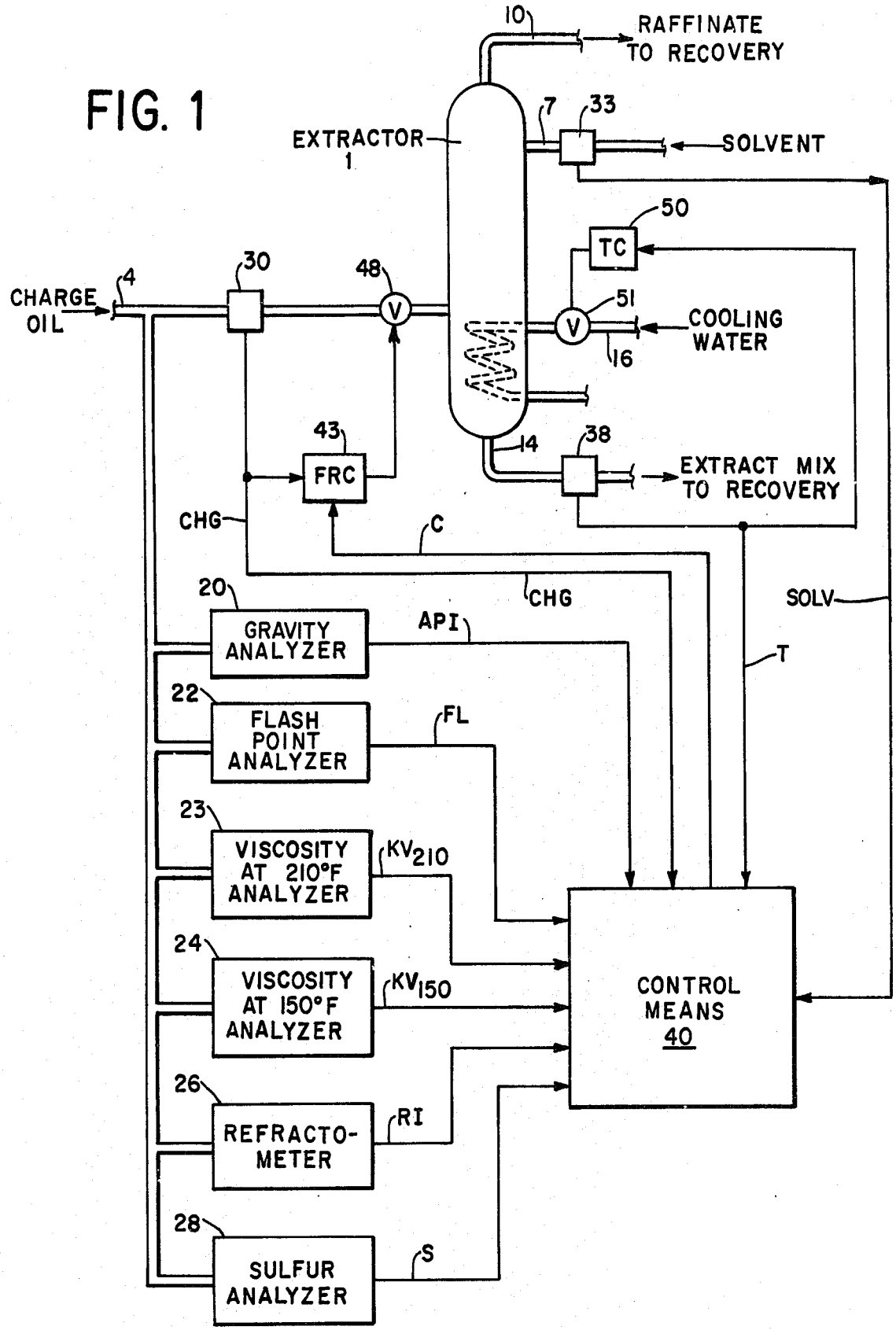
FIG. 1 is a simplified block diagram of a control system, constructed in accordance with the present invention, for controlling an oil refining unit shown in partial schematic form.

An extractor 1 in a furfural refining unit receiving charge oil by way of a line 4 and furfural solvent by way of a line 7 and providing raffinate to recovery by way of a line 10, and an extract mix to recovery by way of a line 14. The temperature in extractor 1 is controlled by cooling water passing through a line 16. A gravity analyzer 29, flash point analyzer 22, viscosity analyzers 23 and 24, a refractometer 26 and a sulfur analyzer 28, sample the charge oil in line 4 and provide signals API, FL, $KV_{210}$, $KV_{150}$, RI and S, respectively, corresponding to the API gravity, the flash point, the kinematic viscosity at 210° F., and the kinematic viscosity at 150° F., the refractive index and the sulfur content, respectively.

A flow transmitter 30 in line 4 provides a signal CHG corresponding to the flow rate of the charge oil in line 4. Another flow transmitter 33 in line 7 provides a signal SOLV corresponding to the furfural flow rate. A temperature sensor 38, sensing the temperature of the extract mix leaving extractor 1, provides a signal T corresponding to the sensed temperature. All signals hereinbefore mentioned are provided to control means 40.

Control means 40 provides signal C to a flow recorder controller 43. Recorder controller 43 receives signals CHG and C and provides a signal to a valve 48 to control the flow rate of the charge oil in line 4 in accordance with signals CHG and C so that the charge oil assumes a desired flow rate. Signal T is also provided to temperature controller 50. Temperature controller 50 provides a signal to a valve 51 to control the amount of cooling water entering extractor 1 and hence the temperature of the extract-mix in accordance with its set point position and signal T.

The following equations are used in practicing the present invention for light sweet charge oil, that is a charge oil having a sulfur content equal to or less than a predetermined sulfur content and having a kinetic viscosity, corrected to a predetermined temperature, equal to or less than a first predetermined kinetic viscosity:

$$1.\ H_{210}=\ln\ln(KV_{210}+C_1)$$

where $H_{210}$ is a viscosity H value for 210° F., $KV_{210}$ is the kinematic viscosity of the charge oil at 210° F. and $C_1$ is a constant having a preferred value of 0.6.

$$2.\ H_{150}=\ln\ln(KV_{150}+C_1)$$

where $H_{150}$ is a viscosity H value for 150° F., and $KV_{150}$ is the kinetic viscosity of the charge oil at 150° F.

$$3.\ K_{150}=[C_2-\ln(T_{150}+C_3)]/C_4$$

where $K_{150}$ is a constant needed for estimation of the kinematic viscosity at 100° F., $T_{150}$ is 150, and $C_2$ through $C_4$ are constants having preferred values of 6.5073, 460 and 0.17937, respectively.

$$4.\ H_{100}=H_{210}+(H_{150}-H_{210})/K_{150}$$

where $H_{100}$ is a viscosity H value for 100° F.

$$5.\ KV_{100}=\exp[\exp(H_{100})]-C_1$$

where $KV_{100}$ is the kinematic viscosity of the charge oil at 100° F.

$$6.\ SUS=C_5(KV_{210})+[C_6+C_7(KV_{210})]/[C_8+C_9(KV_{210})+C_{10}(KV_{210})^2+C_{11}(KV_{210})^3](C_{12})$$

where SUS is a factor needed in equation 7 and $C_5$ through $C_{12}$ are constants having preferred values of 4.6324, 1.0, 0.03264, 3930.2, 262.7, 23.97, 1.646 and $10^{-5}$, respectively.

$$7.\ SUS_{210}=[C_{13}+C_{14}(C_{15}-C_{16})]SUS$$

where $SUS_{210}$ is the viscosity in Saybolt Universal Seconds at 210° F. and $C_{13}$ through $C_{16}$ are constants having preferred values of 1.0, 0.000061, 210 and 100, respectively.

$$8.\ VI_{DWCdi\ O}=C_{17}-C_{18}(FL)+C_{19}(VI)+C_{20}(KV_{210})(\mathrm{API})$$

where $VI_{DWCO}$, FL, VI, and API are the viscosity index of the dewaxed product at zero pour point, the flash point temperature of the charge oil, the viscosity index of the charge oil and the API gravity of the charge oil, respectively, and $C_{12}$ through $C_{20}$ are constants having preferred values of 27.35, 0.1159, 0.69819 and 0.21112, respectively.

$$9.\ VI_{DWCP}=VI_{DWCO}+(\mathrm{Pour})[C_{21}-C_{22}lnSUS_{210}+C_{23}(lnSUS_{210})^2]$$

where $VI_{DWCP}$ and Pour are the viscosity index of the dewaxed product at a predetermined temperature and the Pour Point of the dewaxed product, respectively, and $C_{21}$ through $C_{23}$ are constants having preferred values of 2.856, 1.18 and 0.126, respectively.

$$10.\ \Delta VI=VI_{RO}-VI_{DWCO}=VI_{RP}-VI_{DWCP}$$

where $VI_{RO}$ and $VI_{RP}$ are the VI of the refined oil at 0° F., and at the predetermined temperature, respectively.

$$11.\ A=C_{24}-C_{25}(S)-C_{26}(S)^2+C_{27}(KV_{210})(API)-C_{28}(KV_{210})(VI)-C_{29}(FL)(API)+C_{30}(FL)(S)+C_{31}(FL)(VI)$$

where S is the percent sulfur in the charge oil, and $C_{24}$ through $C_{31}$ are constants having preferred values of 434.074, 88.98932, 22.6125, 3.17397, 1.3905, 0.05033, 0.51586 and 0.01388.

$$12.\ J=\{\{C_{32}-C_{33}A+\{[C_{33}A-C_{32}]^2-4[C_{34}-C_{35}A][-C_{36}+C_{37}\sqrt{T}-C_{38}(A)(\sqrt{T})-\Delta VI]\}^{\frac{1}{2}}\}/2[C_{34}-C_{35}(A)]\}^2$$

where J is the furfural dosage and $C_{32}$ through $C_{39}$ are constants having preferred values of 15.762, 0.075007, 0.25747, 0.0012087, 5.2479, 14.096 and 0.056338.

$$13.\ C=(SOLV)(100)/J$$

For light sour charge oil, that is a charge oil having a sulfur control greater than the predetermined sulfur contant and having temperature corrected kinematic viscosity equal to or less than the first predetermined kinematic viscosity, equations 1 through 10 and 13 are used. However, equation 12 is replaced by the following equation 14.

$$14.\ J=\{\{-C_{39}+\{(C_{39})^2-4(C_{40})(T)[-C_{41}+C_{42}\sqrt{T}-\Delta VI]\}^{\frac{1}{2}}\}/2[C_{40}T]\}^2$$

where $C_{39}$ through $C_{42}$ are constants having preferred values of 3.0093, 0.00023815, 54.88 and 5.3621, respectively.

For medium sweet charge oil, that is a charge oil having a sulfur content equal to or less than the predetermined sulfur content and having a temperature corrected kinematic viscosity greater than the first predetermined kinematic viscosity but equal to or less than a second predetermined kinematic viscosity, equations 1 through 7, 9, 10 and 13 are used, along with the following four equations:

$$15.\ W=C_{43}-C_{44}API+C_{45}/KV_{210}-C_{46}S+C_{47}(API)^2-C_{48}API/KV_{210}+C_{49}(S)(API)$$

where W is the percent wax in the charge oil, and $C_{43}$ through $C_{49}$ are constants having preferred values of 51.17 4.3135, 182.83, 5.2388, 0.101, 6.6106 and 0.19609, respectively.

$$16.\ VI_{DWCO}=C_{50}-C_{51}RI+C_{52}(RI)(VI)+C_{53}(FL)(API)-C_{54}(W)(VI)$$

where $C_{50}$ through $C_{54}$ are constants having preferred values of 2306.54, 1601.786, 1.33706, 0.00945 and 0.20915, respectively.

$$17.\ A=C_{55}-C_{56}(API)+C_{57}(FL)(KV_{210})$$

where $C_{55}$ through $C_{57}$ are constants having preferred values of 860.683, 28.9516 and 0.02389, respectively.

$$18.\ J=\{\{-C_{58}A+\{(C_{58}A)^2-4C_{59}A(C_{60}+C_{61}\sqrt{T}-\Delta VI)\}^{\frac{1}{2}}\}/2C_{59}A\}^2$$

where $C_{58}$ through $C_{61}$ are constants having preferred values of 0.013795, −0.00025376, −18.233 and 1.1031, respectively.

Medium sour charge oil is a charge oil having a sulfur content greater than the predetermined sulfur content and having a temperature corrected kinematic viscosity greater than the first predetermined kinematic viscosity but equal to or less than the second predetermined kinematic viscosity.

For medium sour charge oil, equations 1 through 7, 9, 10, 13, 15, 16 and 17 are used along with the following equation:

$$19.\ J=\{\{-C_{62}+\{(C_{62})^2-4(-C_{63})[C_{64}\sqrt{T}+C_{65}(\sqrt{T})(A)-C_{66}-\Delta VI]\}^{\frac{1}{2}}\}/2(-C_{63})$$

where $C_{62}$ through $C_{66}$ are constants having preferred values of 4.5606, 0.085559, 1.8965, 0.0062567 and 55.744, respectively.

Heavy sweet charge oil is charge oil having a sulfur content equal to or less than the predetermined sulfur content and having a temperature corrected kinematic viscosity greater than the second predetermined kinematic viscosity.

For heavy sweet charge oil, equations 1 through 7, 9, 10, 13 and 15 are used as well as the following equations:

$$20.\ VI_{DWCO}=-C_{67}+C_{68}(KV_{210})^2+C_{69}(VI)-C_{70}(API)(VI)+C_{71}(API)^2+C_{72}(FL)(VI)-C_{73}(W)(KV_{210})$$

where $C_{67}$ through $C_{73}$ are constants having preferred values of 168.538, 0.0468, 3.63863, 0.17523, 0.41542, 0.00106 and 0.21918, respectively.

$$21.\ A=C_{74}-C_{75}(KV_{210})^2+C_{76}(S)+C_{77}(FL)^2-C_{78}(FL)(API)-C_{79}(KV_{210})(\mathrm{S})$$

where $C_{74}$ through $C_{79}$ are constants having preferred values of 503.518, 0.04423, 54.58305, 0.00055, 0.03745 and 1.38869, respectively.

$$22.\ J=(\Delta VI-C_{80}-C_{81}\sqrt{T})/[-C_{82}T+C_{83}(A)(T)]$$

where $C_{80}$ through $C_{83}$ have preferred values of 10.272, 1,0194, 0.00067611 and 0.0000040229, respectively.

Heavy sour charge oil is a charge oil having a sulfur content greater than the predetermined sulfur content and having a temperature corrected kinematic viscosity greater than the second predetermined kinematic viscosity.

For heavy sour charge oil, equations 1 through 7, 9, 10, 13, 15, 20 and 21 and the following equation 23.

$$23.\ J=\{\{-C_{84}(A)+\{[C_{84}(A)]^2-4[C_{85}(A)(T)][-C_{86}+C_{87}(A)(\sqrt{T})-\Delta VI]\}^{\frac{1}{2}}\}/2[C_{85}(A)(T)]\}^2$$

where $C_{84}$ through $C_{87}$ are constants 0.004074, $5.275\times10^{-7}$ 13.199 and 0.0059403, respectively.

Figure 2:
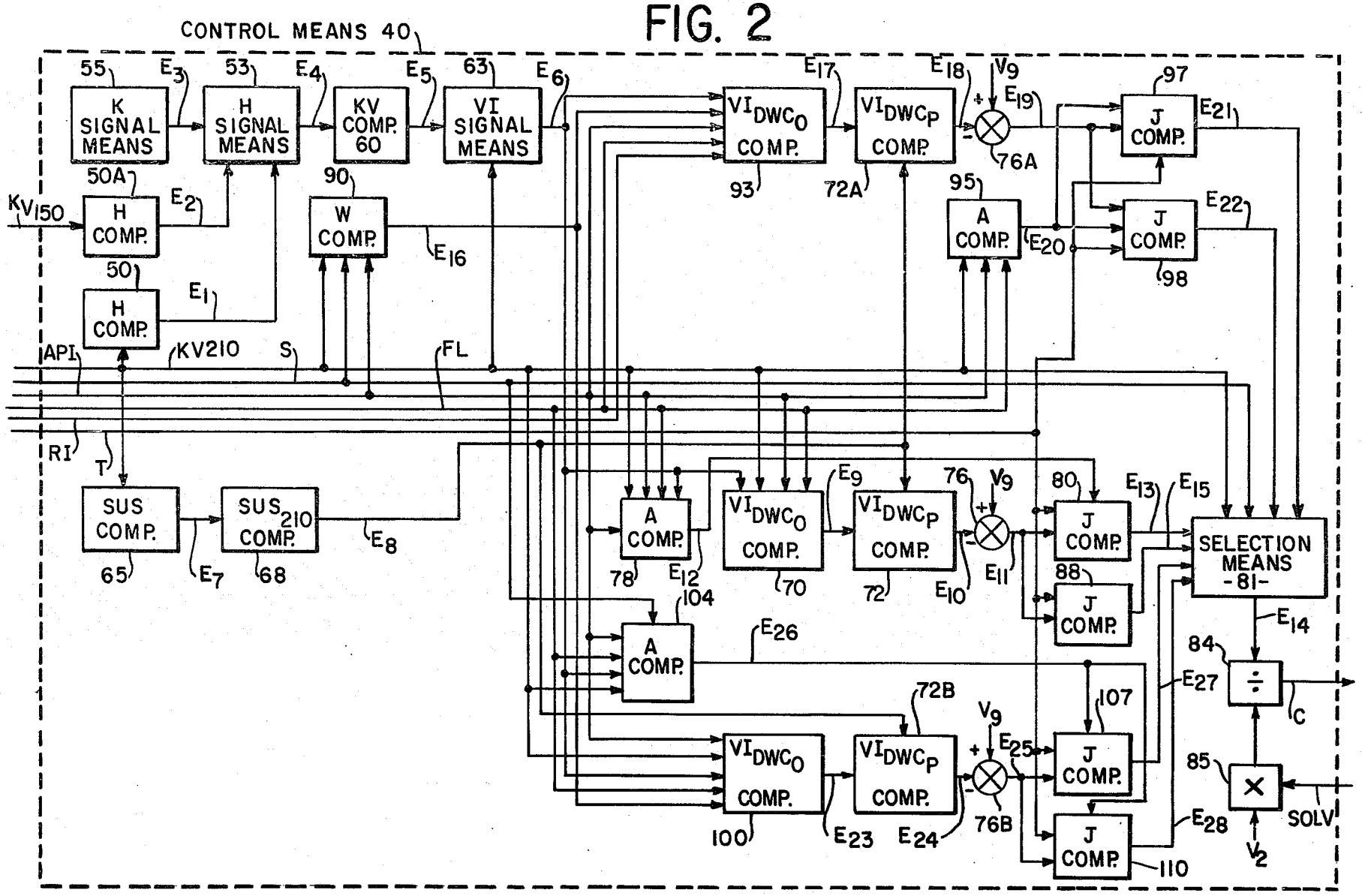
FIG. 2 is a simplified block diagram of the control means shown in FIG. 1.

Referring now to FIG. 2, signal $KV_{210}$ is provided to an H computer 50 in control means 40, while signal $KV_{150}$ is applied to an H computer 50A. It should be noted that elements having a number and a letter suffix are similar in construction and operation as to those elements having the same numeric designation without a suffix. All elements in FIG. 2, except elements whose operation is obvious, will be disclosed in detail hereinafter. Computers 50 and 50A provide signals $E_1$ and $E_2$ corresponding to $H_{210}$ and $H_{150}$, respectively, in equations 1 and 2, respectively, to H signal means 53. K signal means 55 provides a signal $E_3$ corresponding to the term $K_{150}$ in equation 3 to H signal means 53. H signal means 53 provides a signal $E_4$ corresponding to the term $H_{100}$ in equation 4 to a KV computer 60 which provides a signal $E_5$ corresponding to term $KV_{100}$ in accordance with signal $E_4$ and equation 5 as hereinafter explained.

Signals $E_5$ and $KV_{210}$ are applied to VI signal means 63 which provides a signal $E_6$ corresponding to the viscosity index.

An SUS computer 65 receives signal $KV_{210}$ and provides a signal $E_7$ corresponding to the term SUS in accordance with the received signals and equation 6 as hereinafter explained.

An SUS 210 computer 68 receives signal $E_7$ and supplies signal $E_8$ corresponding to the term $SUS_{210}$ in accordance with the received signal and equation 7 as hereinafter explained.

A $VI_{DWC_o}$ computer 70 receives signal $KV_{210}$, API, FL and $E_6$ and provides a signal $E_9$ corresponding to the term $VI_{DWC_o}$ in accordance with the received signals and equation 8 as hereinafter explained.

A $VI_{DWC_p}$ computer 72 receives signal $E_8$ and $E_9$ and provides a signal $E_{10}$ corresponding to the term $VI_{DWC_p}$ in accordance with the received signals and equation 9. Subtracting means 76 performs the function of equation 10 by subtracting signal $E_{10}$ from voltage $V_9$ corresponding to the term $VI_{RP}$, in equation 10, to provide a signal $E_{11}$ corresponding to the term ΔVI in equation 10.

An A computer 78 receives signals API, $KV_{210}$, S, FL and $E_6$ and provide a signal $E_{12}$ corresponding to a term A, in accordance with the received signals and equation 11, as hereinafter explained.

A J computer 80 receives signals T, $E_{11}$ and $E_{12}$ and provides a signal $E_{13}$ corresponding to the term J in accordance with the received signals and equation 12 as hereinafter explained.

It should be noted that the J factor just previously described, is for light sweet charge oil. As the rest of the operation of control means 40 continues to be described it will be noted that there will be a J factor signal for each of the different types of charge oil, that is, light sweet charge oil, light sour charge oil, medium sweet charge oil, medium sour charge oil, heavy sweet charge oil and heavy sour charge oil. It will be appreciated that since there is no previous switching being done that each J computer will provide a J factor signal, so that there will be six J factor signals. However, only one of them is a correct and proper signal and that one signal being associated with the charge oil that is in line 4. Therefore, the J signals such as signal $E_{13}$, are applied to selection means 81, which will be described in greater detail hereinafter. Selection means 81 selects the proper J signal as determined in accordance with the signals $KV_{210}$ and S and provides the selected J signal to a divider 84. A multiplier 85 multiplies signal SOLV with a direct current voltage $V_2$ corresponding to a value of 100 to provide a signal corresponding to the term (SOLV)(100) in equation 13. The signal from multiplier 85 is divided into the signal from selection means 81 to provide signal C.

Another J computer 88 provides a signal $E_{15}$ corresponding to the J factor in equation 14 for light sour charge oil. J computer 88 receives signals $E_{11}$ and T and provide signal $E_{15}$ in accordance with the received signal and equation 14.

A W computer 90 receives signals $KV_{210}$, S and API and provides a signal $E_{16}$ corresponding to the term W in equation 15 in accordance with the received signals and equation 15 as hereinafter explained.

Another $VI_{DWC_o}$ computer 93 receives signals RI, FL, API, $E_6$ and $E_{16}$ and provides a signal $E_{17}$ corresponding to the term $VI_{DWC_o}$ in equation 16 in accordance with the received signals and equation 16 as hereinafter explained. A $VI_{DWC_p}$ computer 72A provides a signal $E_{18}$ corresponding to the term $VI_{DWC_p}$ in equation 9, in accordance with signals $E_8$ and $E_{17}$ and equation 9. Subtracting means 76A subtracts signal $E_{18}$ from voltage $V_9$ to provide a signal $E_{19}$ corresponding to the term ΔVI in equation 10.

An A computer 95 receives signals $KV_{210}$, API and FL and provides a signal $E_{20}$ corresponding to the term A in equation 17, in accordance with the received signals and equation 17 as hereinafter explained. A J computer 97 receives signals T, $E_{19}$ and $E_{20}$ and provides a signal $E_{21}$ corresponding to the J factor in equation 18 for medium sweet charge oil in accordance with the received signals and equation 18 as hereinafter explained. Signal $E_{21}$ is applied to selection means 81.

Another J computer 98 receives signals T, $E_{20}$ and $E_{19}$ to provide a signal $E_{22}$ corresponding to the J factor in equation 19 for medium sour charge oil in accordance with the received signals and equation 19 as hereinafter explained. Signal $E_{22}$ is supplied to selection means 81.

A $VI_{DWC_o}$ computer 100 receives signals $KV_{210}$, API, FL, $E_6$ and $E_{16}$ and provides a signal $E_{23}$ corresponding to the term $VI_{DWC_o}$ in equation 20, in accordance with the received signals and equation 20 as hereinafter explained.

A $VI_{DWC_p}$ computer 72B provides a signal $E_{24}$ corresponding to the term $VI_{DWC_p}$ in equation 9 in accordance with the received signal, signal $E_8$ and equation 9. Subtracting means 76B subtracts signal $E_{24}$ from voltage $V_9$ to provide a signal $E_{25}$ corresponding to the term ΔVI in equation 10.

An A computer 104 receives signals $KV_{210}$, API, FL and S and provides a signal $E_{26}$ corresponding to the term A in equation 21 in accordance with the received signals and equation 21.

A J computer 107 receives signals T, $E_{25}$ and $E_{26}$ to provide a signal $E_{27}$ corresponding to the J term for heavy sweet charge oil in equation 22 in accordance with the received signals and equation 22. Signal $E_{27}$ is applied to selection means 81.

A J computer 110 receives signals T, $E_{25}$ and $E_{26}$ to provide a signal $E_{28}$ corresponding to the J factor for heavy sour charge oil in accordance with the received signal in equation 23, as hereinafter explained. Signal $E_{28}$ is provided to selection means 81.

Figure 3:
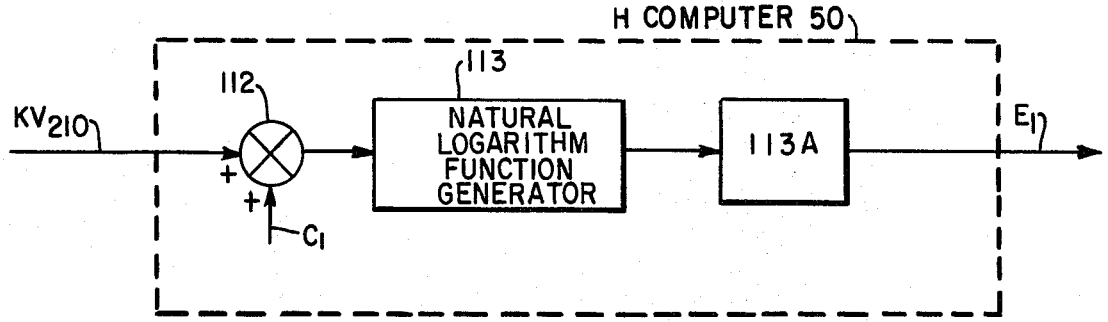
FIGS. 3 through 24 are simplified block diagrams of the H computer, the K signal means, the H signal means, the KV computer, the VI signal means, the SUS computer, the $SUS_{210}$ computer, the $VI_{DWC_o}$ computer, the J computer, the $VI_{DWC_p}$ computer, the A computer, the J computer, the W computer, the $VI_{DWC_o}$ computer, the A computer, the J computer, the J computer and the selection means, respectively, shown in FIG. 2.

Referring now to FIG. 3, H computer 50 includes summing means 112 receiving signal $KV_{210}$ and summing it with a direct current voltage $C_1$ to provide a signal corresponding to the term $[KV_{210}+C_1]$ shown in equation 1. The signal from summing means 112 is applied to a natural logarithm function generator 113 which provides a signal corresponding to the natural log of the sum signal which is then applied to another natural log function generator 113A which in turn provides signal $E_1$.

Figure 4:
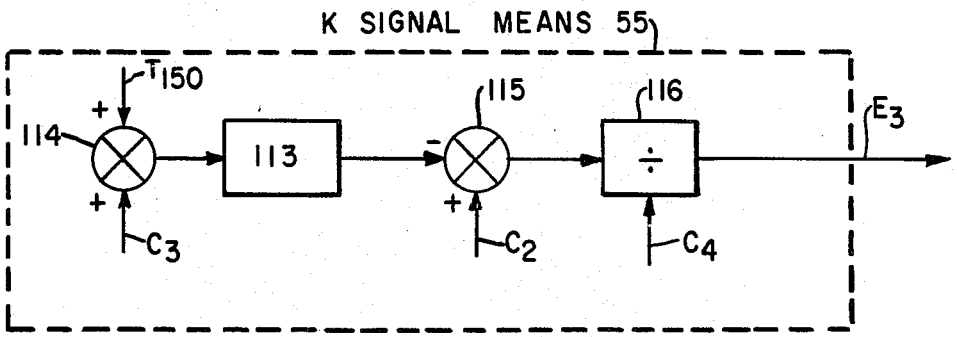

Referring now to FIG. 4, K signal means 55 including summing means 114 summing direct current voltages $T_{150}$ and $C_3$ to provide a signal corresponding to the term $[T_{150}+C_3]$ which is provided to a natural log function generator 113B which in turn provides a signal corresponding to the natural log of the sum signal from summing means 114. Subtracting means 115 subtracts the signal provided by function generator 113B from a direct current voltage $C_2$ to provide a signal corresponding to the numerator of equation 3. A divider 116 divides the signal from subtracting means 115 with a direct current voltage $C_4$ to provide signal $E_3$.

Figure 5:
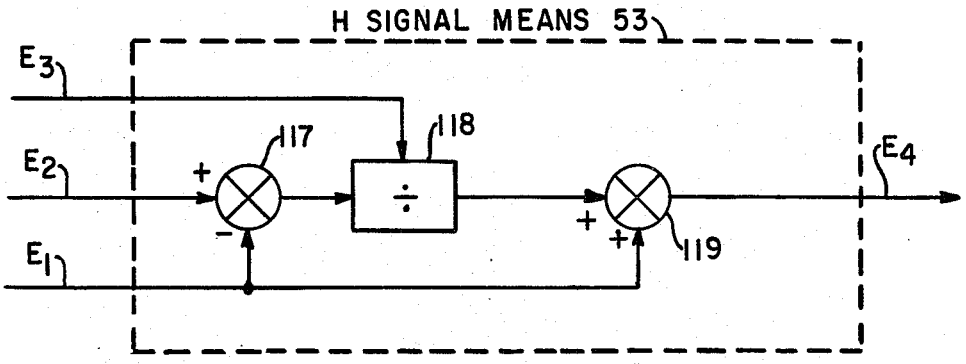

Referring now to FIG. 5, H signal means 53 includes subtracting means 117 which subtracts signal $E_1$ from signal $E_2$ to provide a signal corresponding to the term $H_{150}-H_{210}$, in equation 4, to a divider 118. Divider 118 divides the signal from subtracting means 117 by signal $E_3$. Divider 118 provides a signal which is summed with signal $E_1$ by summing means 119 to provide signal $E_4$ corresponding to $H_{100}$.

Figure 6:
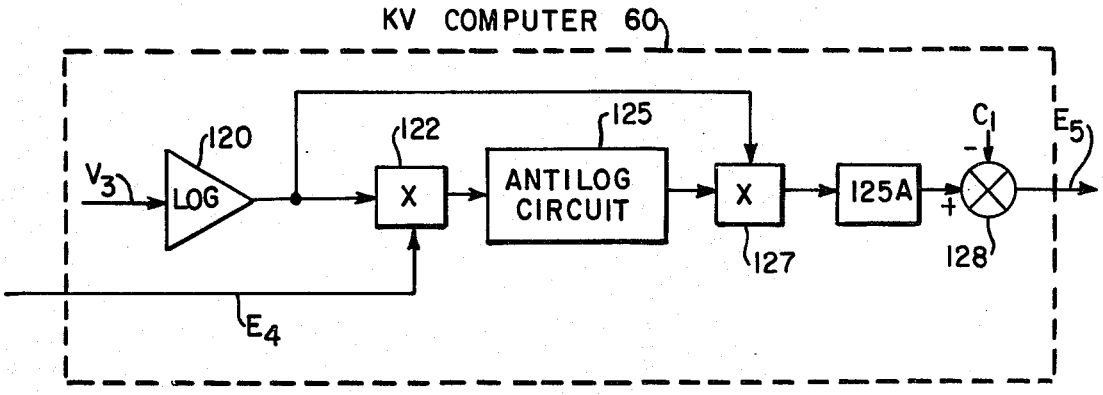

Referring now to FIG. 6, a direct current voltage $V_3$ is applied to a logarithmic amplifier 120 in KV computer 60. Direct current voltage $V_3$ corresponds to the mathematical constant e. The output from amplifier 120 is applied to a multiplier 122 where it is multiplied with signal $E_4$. The product signal from multiplier 122 is applied to an antilog circuit 125 which provides a signal corresponding to the term exp $[H_{100}]$ in equation 5. The signal from circuit 125 is multiplied with the output from logarithmic amplifier 120 by a multiplier 127 which provides a signal to antilog circuit 125A. Signal 125A is provided to subtracting means 128 which subtracts a direct current voltage $C_1$ from signal 125A to provide signal $E_5$.

Figure 7:
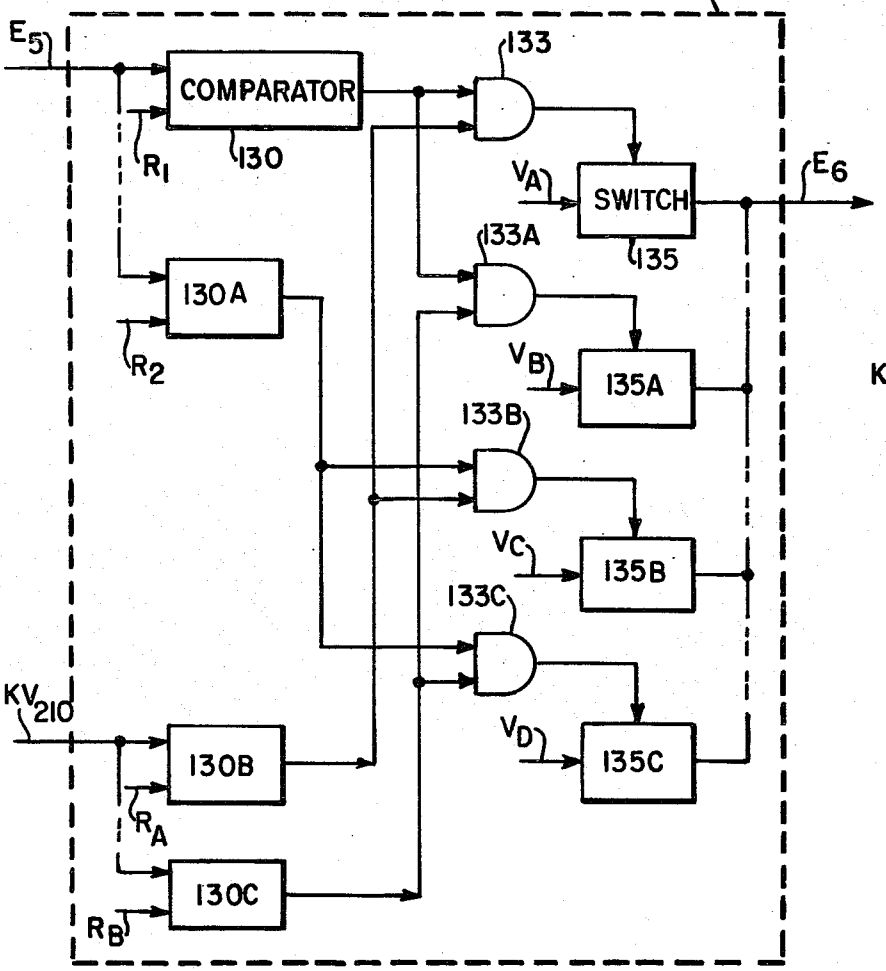

Referring now to FIG. 7, VI signal means 63 is essentially memory means which is addressed by signals $E_5$, corresponding to $KV_{100}$, and signal $KV_{210}$. In this regard, a comparator 130 and comparator 130A represent a plurality of comparators which receive signal $E_5$ and compare signal $E_5$ to reference voltages, represented by voltages $R_1$ and $R_2$, so as to decode signal $E_5$. Similarly, comparators 130B and 130C represent a plurality of comparators receiving signal $KV_{210}$ which compare signal $KV_{210}$ with reference voltages RA and RB so as to decode signal $KV_{210}$. The outputs from comparators 130 and 130B are applied to an AND gate 133 whose output controls a switch 135. Thus, should comparators 130 and 130B provide a high output, AND gate 133 is enabled and causes switch 135 to be rendered conductive to pass a direct current voltage $V_A$, corresponding to a predetermined value, as signal $E_6$ which corresponds to VI. Similarly, the outputs of comparators 130 and 130C control an AND gate 133A which in turn controls a switch 135A to pass or to block a direct current voltage $V_B$. Similarly, another AND gate 133B is controlled by the outputs from comparators 130A and 130B to control a switch 135B so as to pass or block a direct current voltage $V_C$. Again, an AND gate 133C is controlled by the outputs from comparators 130A and 130C to control a switch 135C to pass or to block a direct current voltage $V_D$. The outputs of switches 135 through 135C are tied together so as to provide a common output.

Figure 8:
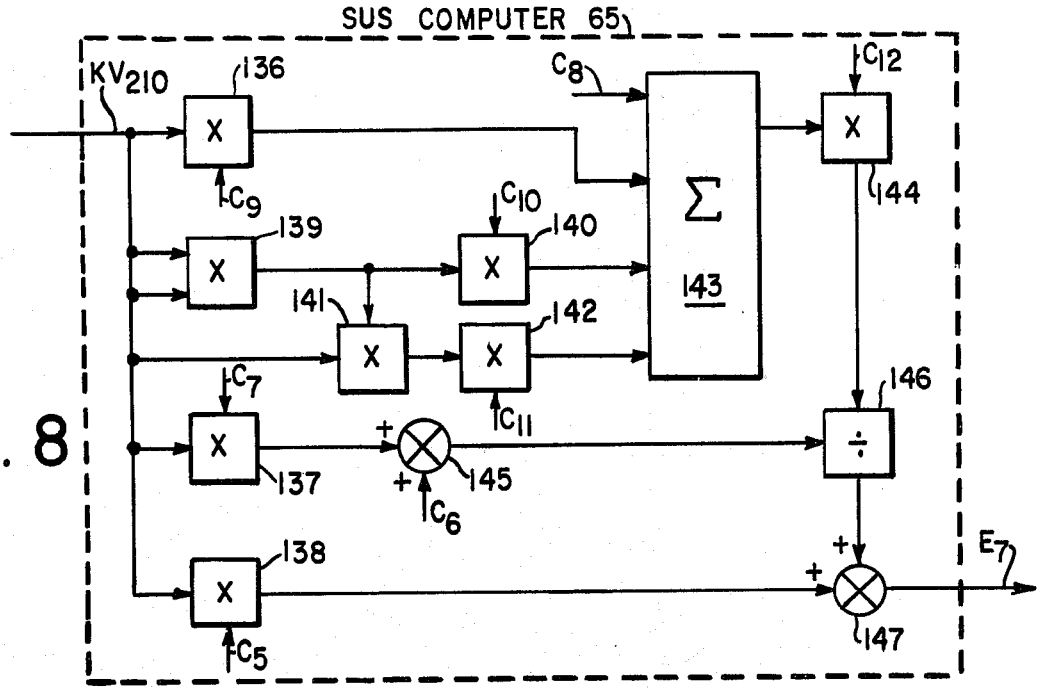

Referring now to FIG. 8, the SUS computer 65 includes multipliers 136, 137 and 138 multiplying signal $KV_{210}$ with direct current voltages $C_9$, $C_7$ and $C_5$, respectively, to provide signals corresponding to the terms $C_9(KV_{210})$, $C_7(KV_{210})$ and $C_5(KV_{210})$, respectively in equation 6. A multiplier 139 effectively squares signal $KV_{210}$ to provide a signal to multipliers 140, 141. Multiplier 140 multiplies the signal from multiplier 139 with a direct current voltage $C_{10}$ to provide a signal corresponding to the term $C_{10}(KV_{210})^2$ in equation 6. Multiplier 141 multiplies the signal from multiplier 139 with signal $KV_{210}$ to provide a signal corresponding to $(KV_{210})^3$. A multiplier 142 multiplies the signal from multiplier 141 with a direct current voltage $C_{11}$ to provide a signal corresponding to the term $C_{11}(KV_{210})^3$ in equation 6. Summing means 143 sums the signals from multipliers 136, 140 and 142 with a direct current voltage $C_8$ to provide a signal to a multiplier 144 where it is multiplied with a direct current voltage $C_{12}$. The signal from multiplier 137 is summed with a direct current voltage $C_6$ by summing means 145 to provide a signal corresponding to the term $[C_6+C_7(KV_{210})]$. A divider 146 divides the signal provided by summing means 145 with the signal provided by multiplier 144 to provide a signal which is summed with the signal from multiplier 138 by summing means 147 to provide signal $E_7$.

Figure 9:
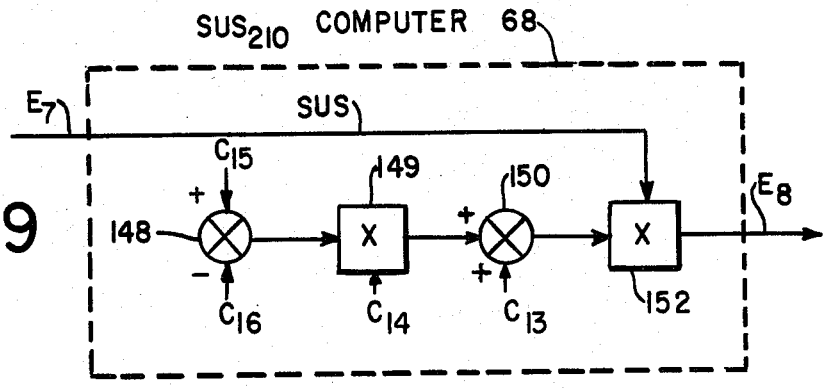

Referring now to FIG. 9, $SUS_{210}$ computer 68 includes subtracting means 148 which subtracts a direct current voltage $C_{16}$ from another direct current voltage $C_{15}$ to provide a signal corresponding to the term $(C_{15}-C_{16})$ in equation 7. The signal from subtracting means 148 is multiplied with a direct current voltage $C_{14}$ by a multiplier 149 to provide a product signal which is summed with another direct current voltage $C_{13}$ by summing means 150. Summing means 150 provides a signal corresponding to the term $[C_{13}+C_{14}(C_{15}-C_{16}]$ in equation 7. The signal from summing means 150 is multiplied with signal $E_7$ by a multiplier 152 to provide signal $E_8$.

Figure 10:
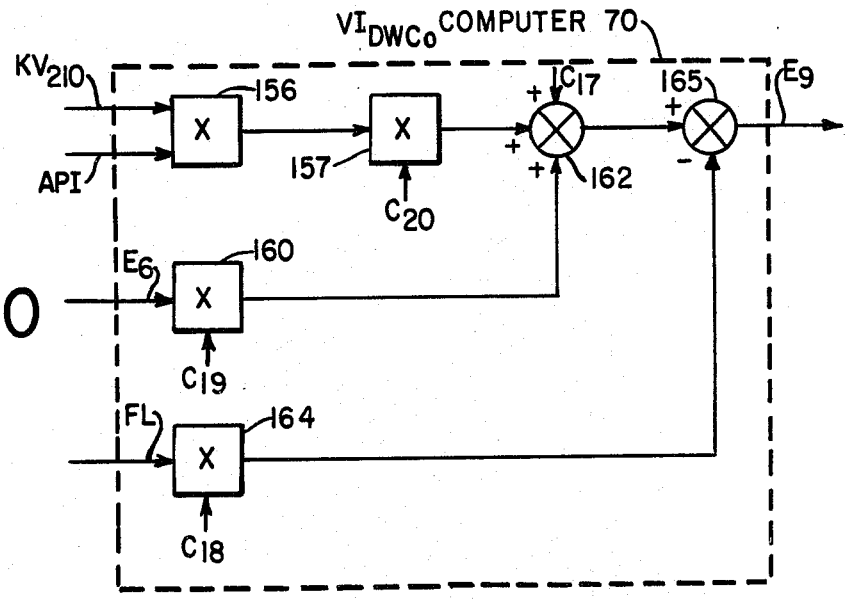

Referring now to FIG. 10, there is shown $VI_{DWC_0}$ computer 70 having a multiplier 156 multiplying signals $KV_{210}$ and API to provide a signal corresponding to the term $(KV_{210})$ (API) in equation 8. Another multiplier 157 multiplies the signal from multiplier 156 with direct current voltage $C_{20}$ to provide a signal corresponding to the term $C_{20}(KV_{21})$ (API). A multiplier 160 multiplies signal $E_6$ with direct current voltage $C_{19}$ to provide a signal corresponding to the term $C_{19}$(VI). Summing means 162 sums the signals from multiplies 157 and 160 with a direct current voltage $C_{17}$ to provide a sum signal. Multiplier 164 multiplies signal FL with direct current voltage $C_{18}$ to provide a signal corresponding to the term $C_{18}$(FL) in equation 8. Subtracting means 165 subtracts the signal provided by multiplier 164 from the signal provided by summing means 162 to provide signal $E_9$.

Figure 11:
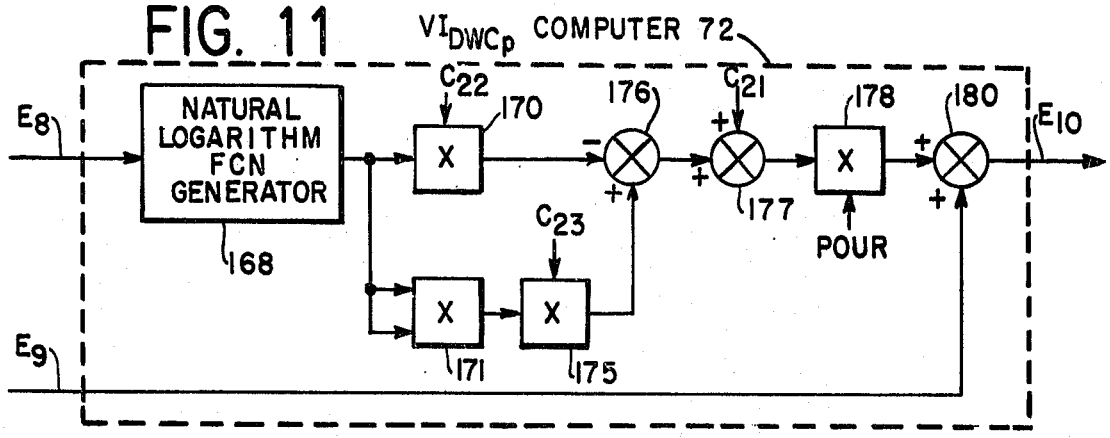

$VI_{DWC_p}$ computer 72 shown in FIG. 11, includes a natural logarithm function generator 168 receiving signal $E_8$ and providing a signal corresponding to the term $\ln SUS_{210}$ to multipliers 170 and 171. Multiplier 170 multiplies the signal from function generator 168 with a direct current voltage $C_{22}$ to provide a signal corresponding to the term $C_{22} \ln SUS_{210}$ in equation 9. Multiplier 171 effectively squares the signal from function generator 168 to provide a signal that is multiplied with the direct current voltage $C_{23}$ by a multiplier 175. Multiplier 175 provides a signal corresponding to the term $C_{23} (\ln SUS_{210})^2$ in equation 9. Subtracting means 176 subtracts the signals provided by multiplier 170 from the signal provided by multiplier 175. Summing means 177 sums the signal from subtracting means 176 with a direct current voltage $C_{21}$. A multiplier 178 multiplies the sum signals from summing means 177 with a direct current voltage POUR to provide a signal which is summed with signal $E_9$ by summing means 180 which provides signal $E_{10}$.

Figure 12:
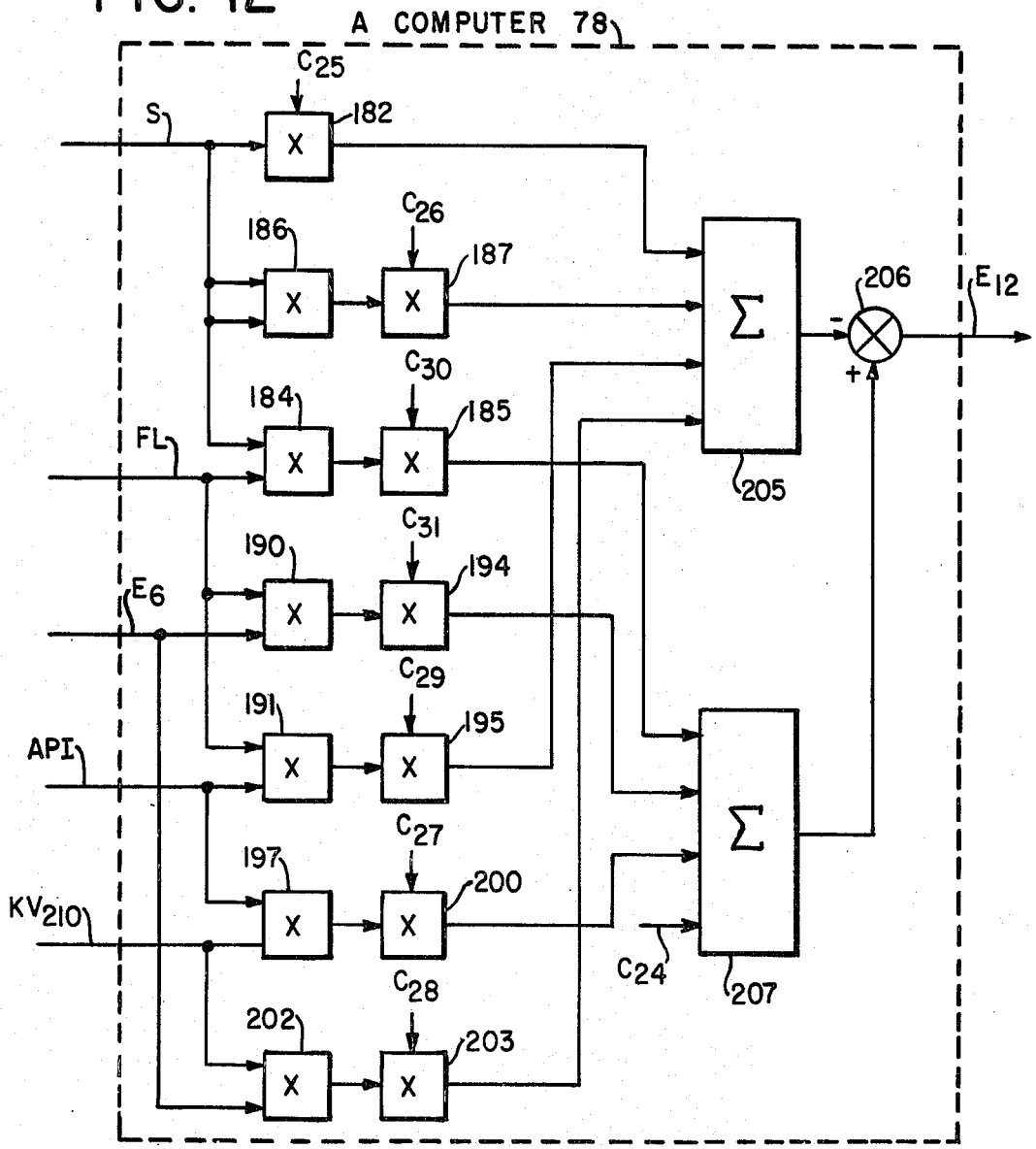

Referring now to FIG. 12, A computer 78 includes multipliers 182, 184 multiplying signal S with a direct current voltage $C_{25}$ and signal FL, respectively, to provide signals corresponding to the term $C_{25}(S)$ and (FL) (S), respectively, in equation 11. The signal from multiplier 184 is multiplied with a direct current voltage $C_{30}$ to provide a signal corresponding to the term $C_{30}$(FL) (S) by a multiplier 185. A multiplier 186 effectively squares signal S and provides it to a multiplier 187 where it is multiplied with a direct current voltage $C_{26}$ to provide a signal corresponding to the term $C_{26}(S)^2$. Signal FL is also applied to multipliers 190, 191 where it is multiplied with signals $E_6$ and API, respectively, to provide product signals to multipliers 194 and 195, respectively. Multipliers 194, 195 multiply the received signals with direct current voltages $C_{31}$ and $C_{29}$, respectively, to provide signals corresponding to the terms $C_{31}$(FL) (VI) and $C_{29}$(FL) (API) in equation 11. Signal API is also multiplied with signal $KV_{210}$ by a multiplier 197 and its product signal is provided to another multiplier 200 where it is multiplied with a direct current voltage $C_{27}$. Multiplier 200 provides a signal corresponding to the term $C_{27}(K_{210})$ (API). A multiplier 202 multiplies signal $E_6$ with signal $KV_{210}$ to provide a signal to a multiplier 203 where it is multiplied with a direct current voltage $C_{28}$. Multiplier 203 multiplies a signal corresponding to the term $C_{28}(KV_{210})$ (VI). Summing means 205 in summing the signals from multipliers 182, 187, 195 and 203 in effect in summing all of the negative terms in equation 11 and provides them to subtracting means 206. Summing means 207 is summing the outputs from multipliers 185, 194 and 200 with a direct current voltage $C_{24}$ in effect is summing all of the positive terms in equation 11 to provide them to subtracting means 206 where the signal from summing means 205 is subtracted from it to provide signal $E_{12}$.

Figure 13:
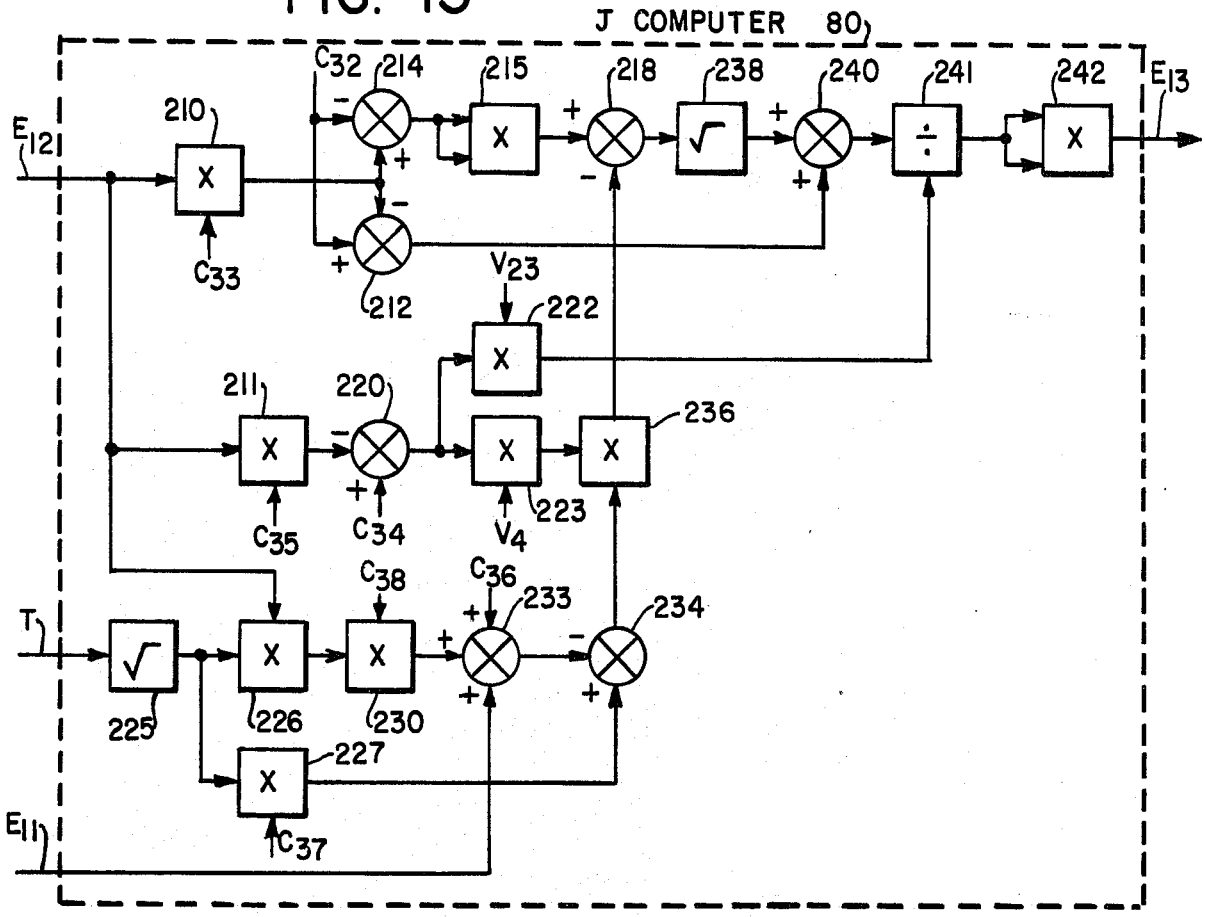

In FIG. 13, J computer 80 includes multipliers 210, 211 multiplying signal $E_{12}$ with direct current voltages $C_{33}$ and $C_{35}$, respectively, to provide signals corresponding to the terms $C_{33}A$ and $C_{35}A$ in equation 12, respectively. The signal from multiplier 210 is subtracted from a direct current voltage $C_{32}$ by subtracting means 212, while subtracting means 214 subtracts voltage $C_{32}$ from the signal provides by multiplier 210. Thus, subtracting means 212, 214 provide signals corresponding to the terms $C_{33}A - C_{32}$ and $C_{32} - C_{33}A$, respectively, in equation 12. A multiplier 215 effectively squares the signal from subtracting means 214 to provide a signal to subtracting means 218.

The signal provided by multiplier 211 is subtracted from a direct current voltage $C_{34}$ by subtracting means 220 to provide a signal corresponding to the term $[C_{34} - C_{35}(A)]$ in equation 12. Multipliers 222 and 223 multiply the signal from subtracting means 220 with direct current voltages $V_{23}$ and $V_4$, corresponding to the values of 2 and 4, to provide product signals. Signal T is applied to a conventional type square root circuit 225 which provides a signal to multipliers 226, 227 where the signal is multiplied with signal $E_{12}$ and direct current voltage $C_{37}$, respectively. Multipliers 226 and 227 provide signals corresponding to the term (A) ($\sqrt{T}$) and to $C_{37}\sqrt{T}$, respectively, in equation 12. The signal from multiplier 226 is multiplied with a direct current voltage $C_{38}$ by a multiplier 230 which provides a signal to summing means 233 where it is summed with another direct current voltage $C_{36}$ and a signal $E_{11}$ by summing means 233. Summing means 233 effectively sums the negative terms which are shown as being $-C_{36}$, $-C_{38}(A)$ ($\sqrt{T}$) and $-\Delta VI$.

Subtracting means 234 subtracts the signal provided by summing means 233 from the signal provided by multiplier 227 to provide a difference signal. A multiplier 236 multiplies the signal from multiplier 223 and subtracting means 234 to provide a signal which is subtracted from the signal provided by multiplier 215 by subtracting means 218. Subtracting means 218 provides a signal to a square root circuit 238 which provides a signal to summing means 240. Summing means 240 adds a signal provided by subtracting means 212 to the signal provided by square root circuit 238. A divider 241 divides the signal from multiplier 222 into a signal provided by summing. Dividing means 241 provides a signal that is effectively squared by a multiplier 242 to provide signal $E_{13}$.

Figure 14:
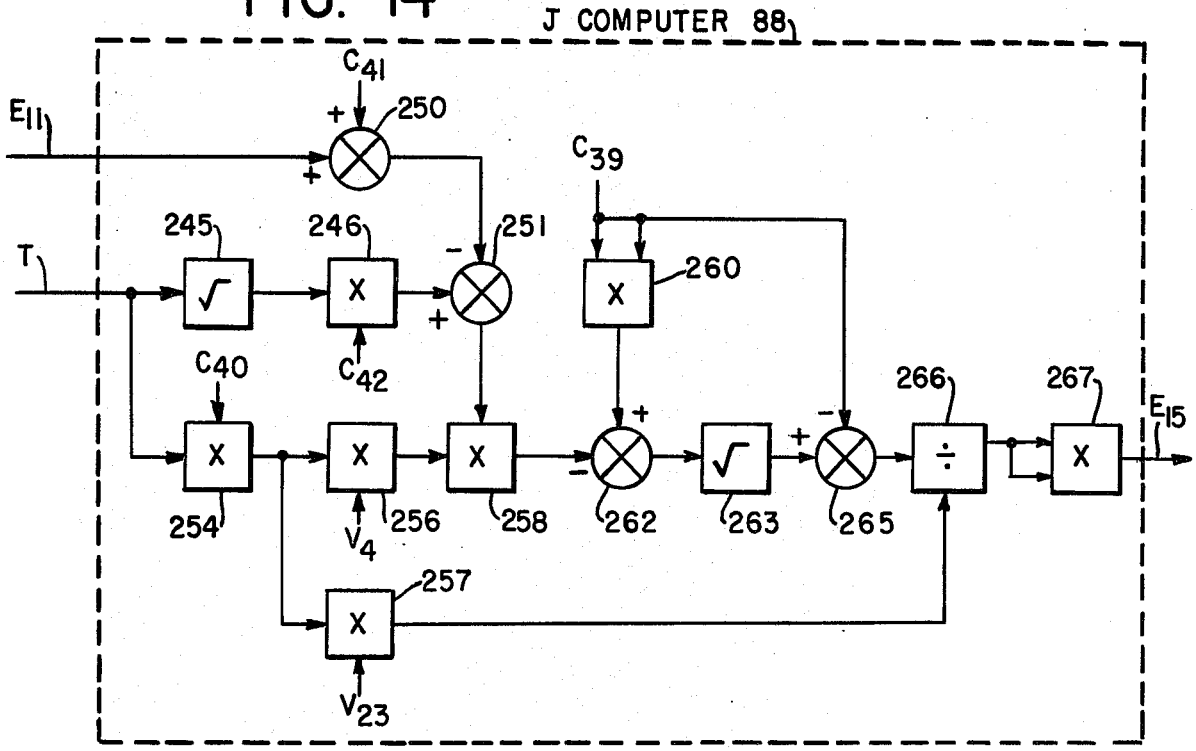

Referring now to FIG. 14, J computer 88 includes a square root circuit 245 receiving signal T and providing a signal to a multiplier 246 where it is multiplied with a direct current voltage $C_{42}$. Signal $E_{11}$ is summed with a direct current voltage $C_{41}$ by summing means 250 to provide a sum signal to subtracting means 251. Subtracting means 251 subtracts the signal provided by summing means 250 from the signal provided by multiplier 246. A multiplier 254 multiplies signal T with a direct current voltage $C_{40}$ to provide a signal to multipliers 256, 257 which multiplies the signal with direct current voltages $V_4$ and $V_{23}$, corresponding to values of 4 and 2, respectively. Multiplier 256 provides a signal, corresponding to the term $4(C_{40})$ (T) in equation 14, to a multiplier 258 where it is multiplied with the signal from subtracting means 251.

A multiplier 260 effectively squares a direct current voltage $C_{39}$ to provide a signal corresponding to the term $(C_{39})^2$ in equation 14. Subtracting means 262 subtracts the signal provided by multiplier 258 from the signal provided by multiplier 260 to provide a signal to a square root circuit 263. Subtracting means 265 subtracts voltage $C_{39}$ from the signal provided by square root circuit 263 to provide a signal to a divider 266. Divider 266 divides the signal from subtracting means 265 with the signal from multiplier 257 to provide a signal that is effectively squared by a multiplier 267 to provide signal $E_{15}$.

Figure 15:
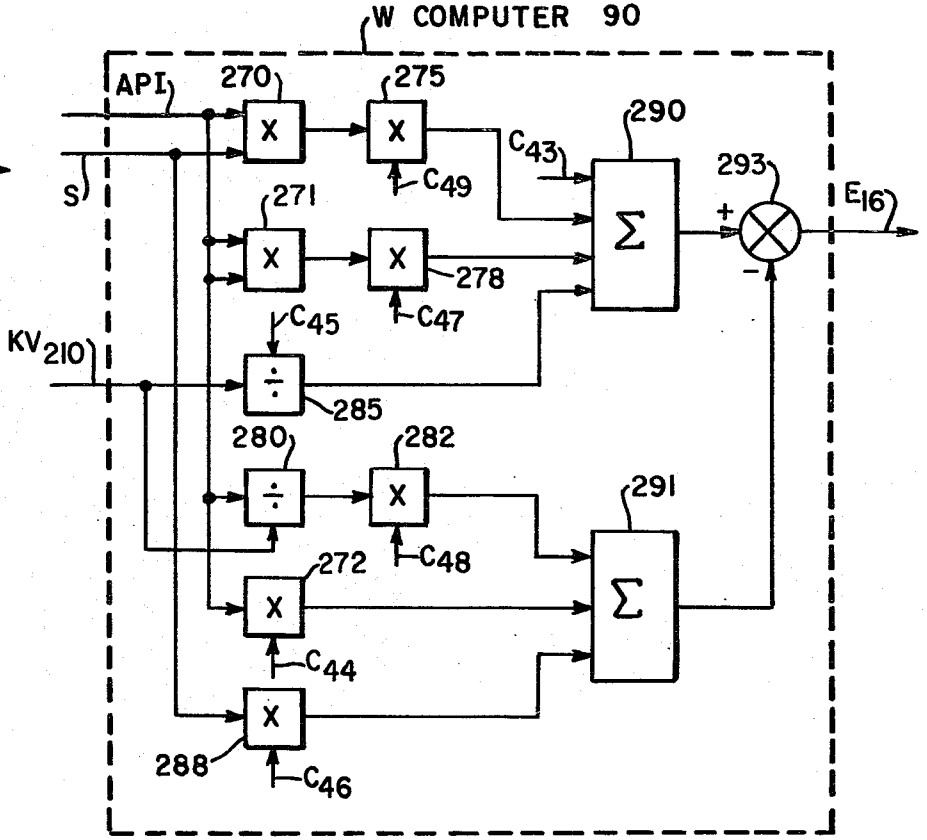

Referring now to FIG. 15, there is shown W computer 90 having multipliers 270, 271 and 272 receiving signal API. Multiplier 270 multiplies signal API with signal S to provide a product signal to another multiplier 275 where it is multiplied with a direct current voltage $C_{49}$ to provide a signal corresponding to the term $C_{49}$(S) (API) in equation 15. Multiplier 271 effectively squares signal API and provides a signal to another multiplier 278 where it is multiplied with a direct current voltage $C_{47}$ to provide a signal corresponding to the term $C_{47}(API)^2$. Multiplier 272 multiplies signal API with a direct current voltage $C_{44}$ to provide a signal corresponding to the term $C_{44}$(API). A divider 280 divides signal API with signal $KV_{210}$ to provide another signal to a multiplier 282 where it is multiplied with a direct current voltage $C_{48}$, which in turn provides a signal corresponding to the term $[C_{48}(API)/(KV_{210})]$ in equation 15. A divider 285 divides a direct current voltage $C_{45}$ with signal $KV_{210}$ to provide a signal corresponding to the term $C_{45}/(KV_{210})$. A multiplier 288 multiplies signal S with a direct current voltage $C_{46}$. Summing means 290 sums a direct current voltage $C_{43}$ with the signals provided by multipliers 275, 278 and divider 285. Other summing means 291 sums the signals provided by multipliers 272, 282 and 288. Subtracting means 293 subtracts the signal provided by summing means 291 from the signal provided by summing means 290 to provide signal $E_{16}$.

Figure 16:
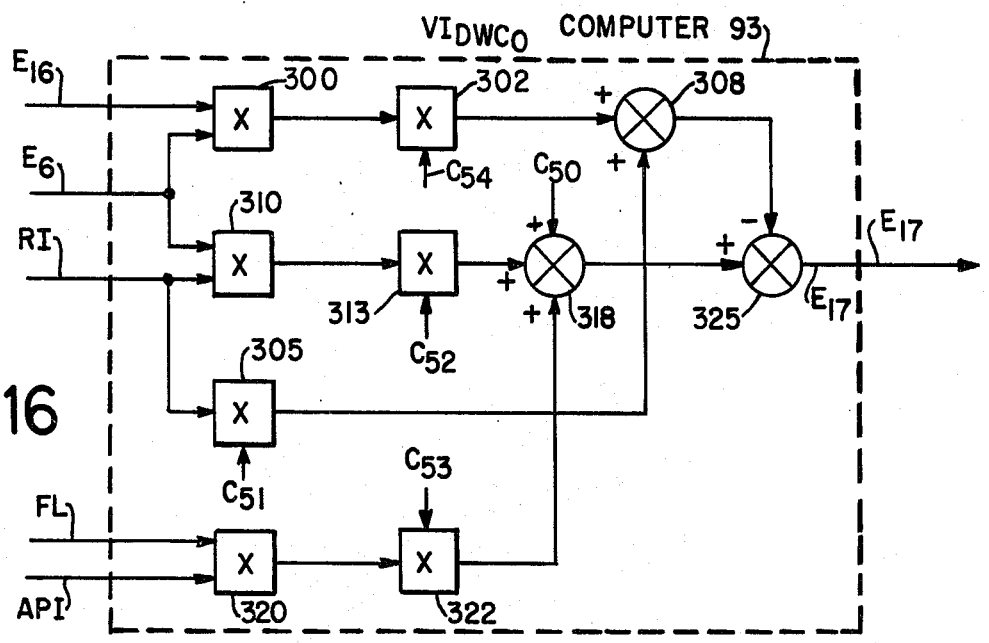

Referring now to FIG. 16, $VI_{DWC_o}$ computer 93 includes a multiplier 300 receiving signals $E_6$, $E_{16}$ and providing a product signal to another multiplier 302 where it is multiplied with a direct current voltage $C_{54}$. Multiplier 302 provides a signal corresponding to the term $C_{54}$(W) (VI) in equation 16. Another multiplier 305 multiplies signal RI with a direct current voltage $C_{51}$ to provide a signal corresponding to the term ($C_{51}$) (RI). Summing means 308 sums the signals from multipliers 302, 305.

A multiplier 310 multiplies signals $E_6$ and RI to provide a product signal to another multiplier 313 where it is multiplied with a direct current voltage $C_{52}$. Multiplier 313 provides a product signal to summing means 318. Another multiplier 320 multiplies signals FL and API to provide a product signal to a multiplier 322 where it is multiplied with a direct current voltage $C_{53}$. Multiplier 322 provides a signal corresponding to the term $C_{53}$ (FL) (API) in equation 16 to summing means 318 where it is summed with the signal from multiplier 315 and a direct current voltage $C_{50}$ to provide a sum signal. Subtracting means 325 subtracts the sum signal provided by summing means 308 from the signal provided by summing means 318 to provide signal $E_{17}$.

Figure 17:
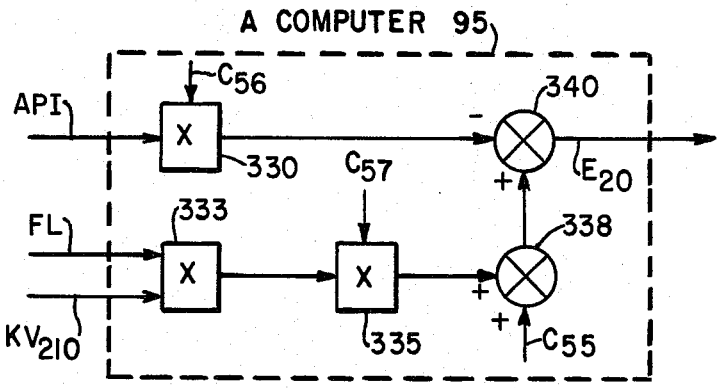

Referring now to FIG. 17, A computer 95 includes a multiplier 330 multiplying signal API with a direct current voltage $C_{56}$ to provide a signal corresponding to the term $C_{56}$(API) in equation 17. Another multiplier 333 multiplies signals FL and $KV_{210}$ to provide a product signal to a multiplier 335 where it is multiplied with a direct current voltage $C_{57}$. Multiplier 335 provides a product signal corresponding to the term $C_{57}$(FL) ($KV_{210}$) in equation 17 to summing means 338. Summing means 338 sums the signal provided by multiplier 335 with a direct current voltage $C_{55}$ to provide a sum signal. Subtracting means 340 subtracts the signal provided by multiplier 330 from the sum signal provided by summing means 338 to provide signal $E_{20}$.

Figure 18:
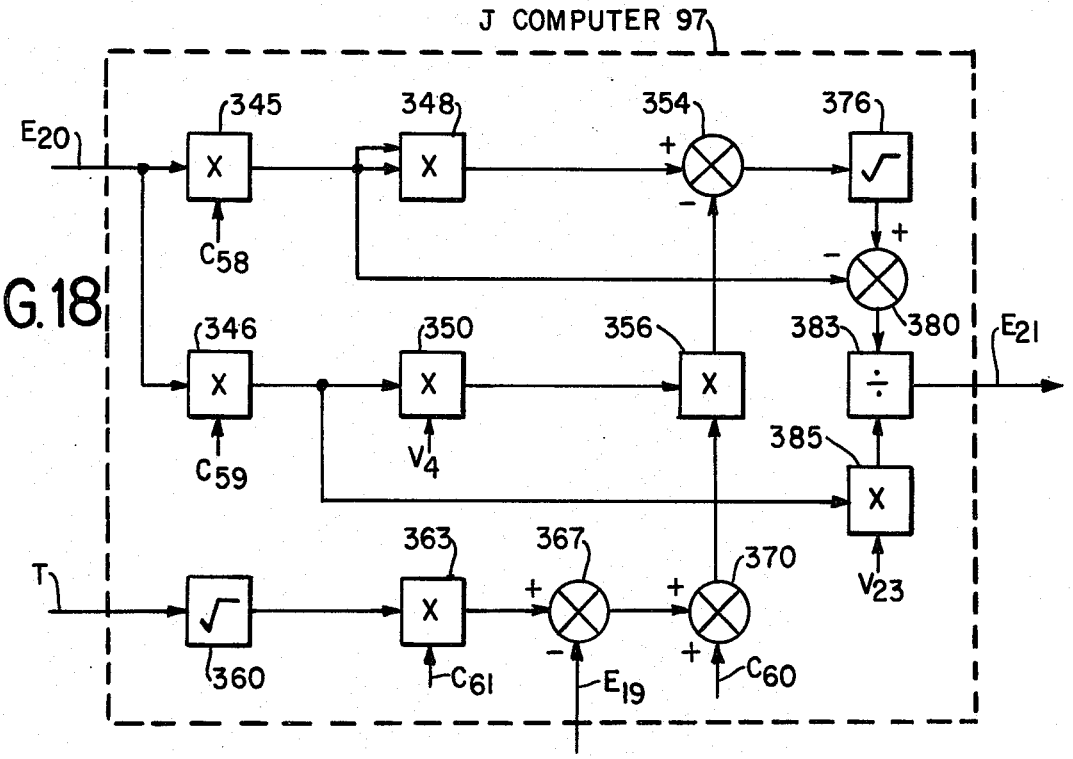

Referring now to FIG. 18, J computer 97 includes multipliers 345 and 346 multiplying signal $E_{20}$ with direct current voltages $C_{58}$ and $C_{59}$, respectively. Multiplier 348 effectively squares the signal provided by multiplier 345 to provide a signal corresponding to the term $(C_{58}A)^2$ to subtracting means 354. Multiplier 350 multiplies the signal from multiplier 346 with a direct current voltage $V_4$ corresponding to a value of 4 to provide a product signal to another multiplier 356.

A square root circuit 360 receives signal T and provides a signal corresponding to $\sqrt{T}$ to a multiplier 233 where it is multiplied with a direct current voltage $C_{61}$. Multiplier 363 provides a product signal to subtracting means 367 where signal $E_{19}$ corresponding to $\Delta VI$ is subtracted from it to provide a difference signal. Summing means 370 sums the difference signal from subtracting means 367 with direct current voltage $C_{60}$ to provide a signal corresponding to the term $[C_{60}+C_{61}(T)^{\frac{1}{2}}-\Delta VI]$ in equation 18 to multiplier 356. Multiplier 356 multiplies the signal provided by multiplier 350 with the signal provided by summing means 370 to provide a signal to subtracting means 354 where it is subtracted from the signal provided by multiplier 348. Subtracting means 354 provides a difference signal to a square root circuit 376 which provides a signal to subtracting means 380. Subtracting means 380 subtracts the signal provided by multiplier 345 from the signal provided by square root circuit 376 to provide a signal to a divider 383. A multiplier 385 multiplies a direct current voltage $V_{23}$, corresponding to a value of 2, with the signal provided by multiplier 346 to provide a product signal to divider 383 where it is divided into the signal provided by subtracting means 380. Divider 383 provides signal $E_{21}$.

Figure 19:
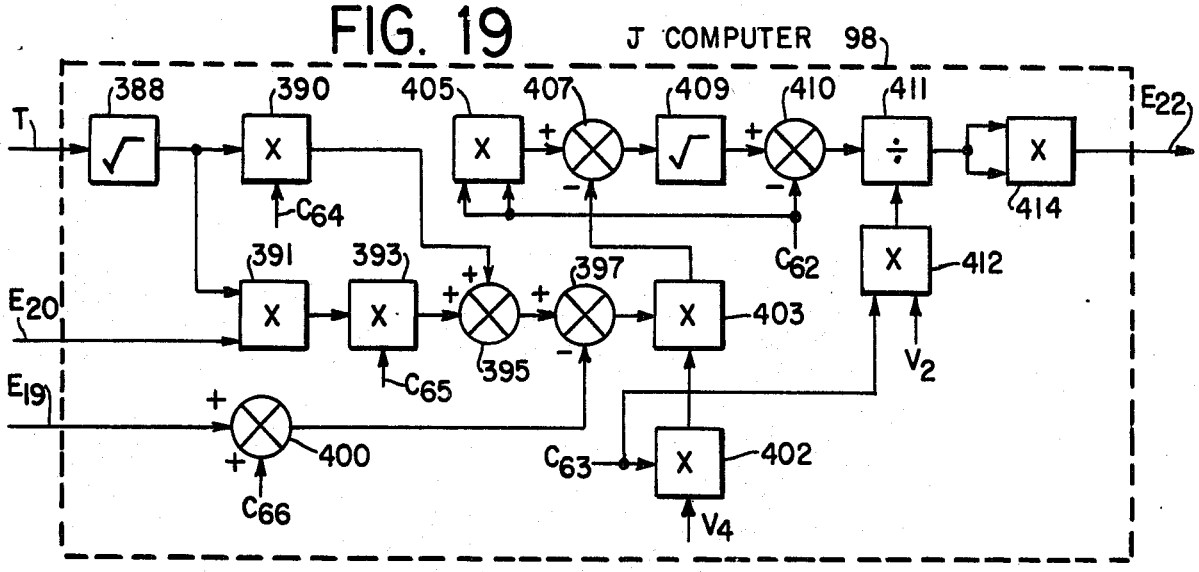

Referring now to FIG. 19, J computer 98 includes a square root circuit 388 receiving signal T to provide a signal to multipliers 390 and 391. Multiplier 390 multiplies the signal from square root circuit 388 with a direct current voltage $C_{64}$ to provide a signal corresponding to the term $C_{64}$ T in equation 19. Multiplier 391 multiplies the signal from square root circuit 388 with signal $E_{20}$ to provide a signal to another multiplier 393 where it is multiplied with a direct current voltage $C_{65}$. Multiplier 393 provides a signal corresponding to the term $C_{65}$ (T)(A) in equation 19. Summing means 395 sums the signals from multipliers 390, 393 to provide a sum signal to subtracting means 397. Summing means 400 sums signal $E_{19}$ with a direct current voltage $C_{66}$ to provide a signal which is subtracted from the signal provided by summing means 395 by subtracting means 397. A multiplier 402 multiplies direct current voltages $C_{63}$ and $V_4$ to provide a signal to another multiplier 403 where it is multiplied with the signal provided by subtracting means 397. A multiplier 405 effectively squares direct current voltage $C_{62}$ and provides it to subtracting means 407. Subtracting means 407 subtracts the signal from multiplier 403, from the signal from multiplier 405 and provides a signal to a square root circuit 409. Subtracting means 410 subtracts voltage $C_{62}$ from the signal provided by square root circuit 409 to provide a signal to a divider 411. A multiplier 412 multiplies voltages $C_{63}$ and $V_{23}$ to provide a signal to divider 411 which divides it into the signal from subtracting means 410. The signal provided by divider 411 is effectively squared by multiplier 414 to provide signal $E_{22}$.

Figure 20:
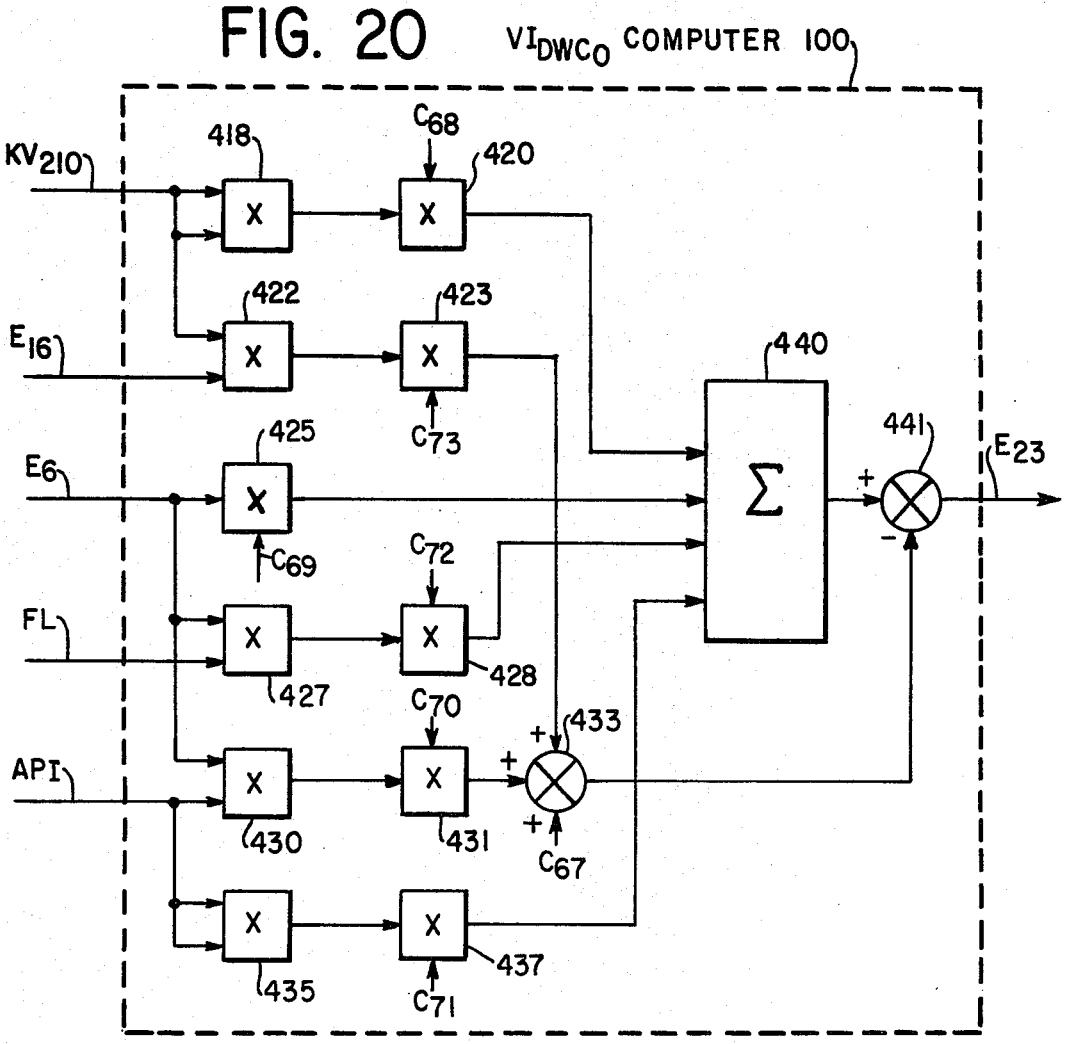

Referring now to FIG. 20, a multiplier 418 effectively squares signal $KV_{210}$ and provides it to a multiplier 420 where it is multiplied with direct current voltage $C_{68}$. Multiplier $C_{420}$ provides a signal corresponding to the term $C_{68}(KV_{210})^2$ in equation 20. A multiplier 422 multiplies signals $KV_{210}$, $E_{16}$ to provide a signal to another multiplier 423 where it is multiplied with direct current voltage $C_{73}$. Multiplier 423 provides a signal corresponding to the term $C_{73}(W)$ $(KV_{210})$ in equation 20. A multiplier 425 multiplies signal $E_6$ with a direct current voltage $C_{69}$ to provide a signal corresponding to the term $C_{69}(VI)$ in equation 20. Another multiplier 427 multiplies signals $E_6$, FL to provide a signal to a multiplier 428 where it is multiplied with a direct current voltage $C_{72}$. Multiplier 428 provides a signal corresponding to the term $C_{72}(FL)$ (VI) in equation 20. A multiplier 430 multiplies signals $E_6$ and API to provide a signal to another multiplier 431 where it is multiplied with direct current voltage $C_{70}$. A product signal provided by multiplier 431 is summed with another direct current voltage $C_{67}$ and the signal from multiplier 423 by summing means 433 to provide a signal corresponding to the term $-C_{67}-C_{70}(API)$ $(VI)-C_{73}$ $(W)(KV_{210})$. A multiplier 435 effectively squares signal API an provides it to a multiplier 437 where it is multiplied with a direct current voltage $C_{71}$. Multipler 437 provides a signal $C_{71}(API)^2$. Summing means 440 sums the signal from multipliers 420, 425, 428 & 437. Subtracting means 441 subtracts the signal provided by summing means 433 from the signal provided by summing means 440 to provide signal $E_{23}$.

Figure 21:
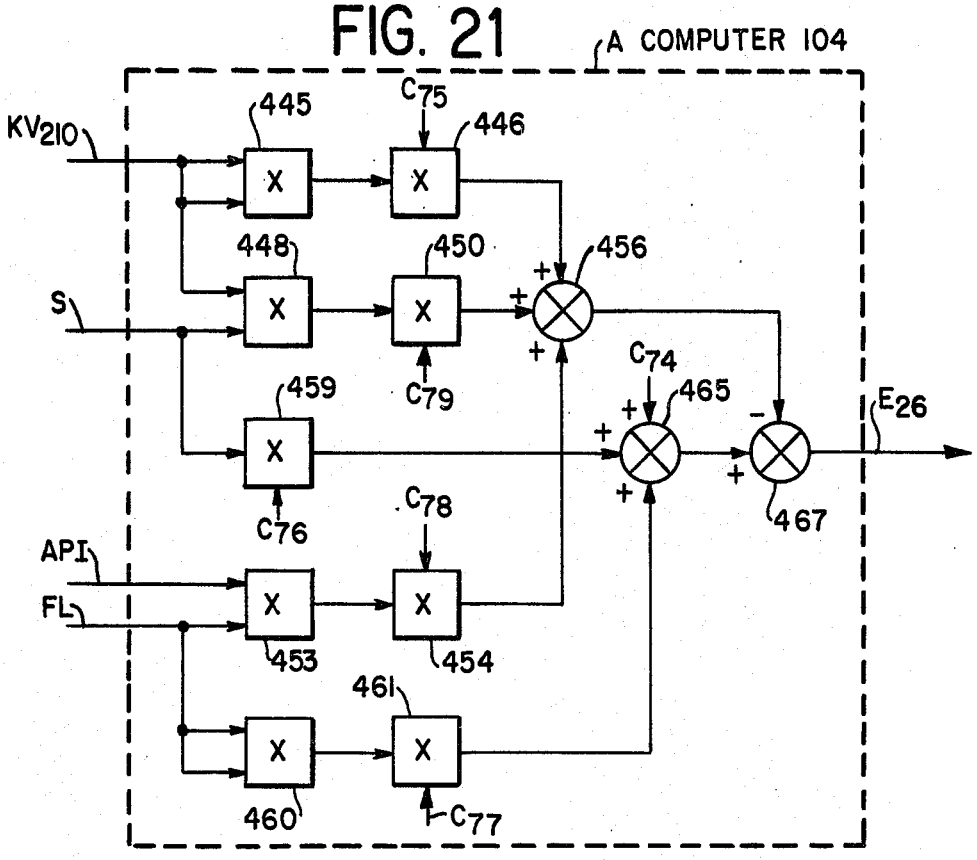

FIG. 21 shows A computer 104 having a multiplier 445 effectively squaring signal $KV_{210}$ to provide a signal which is multiplied with a direct current voltage $C_{75}$ by a multiplier 446 which provides a signal corresponding to the term $C_{75}(KV_{210})^2$ in equation 21. Multiplier 448 multiplies signals $KV_{210}$, S to provide a signal that is multiplied with a direct current voltage $C_{79}$ by a multiplier 450. Multiplier 450 provides a signal corresponding to the term $C_{79}$ $(KV_{210})$ (S) in equation 21. A multiplier 453 multiplies signals API, FL to provide a signal to another multiplier 454 where it is multiplied by a direct current voltage $C_{78}$. Multiplier 454 provides the signal corresponding to the term $C_{78}(FL)$ (API) in equation 21. Summing means 456 essentially sums all of the negative terms in equation 21 by summing the signals from multipliers 446, 450 and 454. A multiplier 459 multiplies signal S with a direct current voltage $C_{76}$ to provide a signal corresponding to the term $C_{76}(S)$ in equation 21. Another multiplier 460 effectively squares signal FL and provides it to yet another multiplier 461 where it is multiplied with a direct current voltage $C_{77}$. Multiplier 461 provides a signal corresponding to the term $C_{77}(FL)^2$. Summing means 465 essentially sums the positive terms of equation 21 by summing a direct current voltage $C_{74}$ with the signals provided by multipliers 459 and 461. Subtracting means 467 subtracts the signal provided by summing means 456 from the signal provided by summing means 465 to provide signal $E_{26}$.

Figure 22:
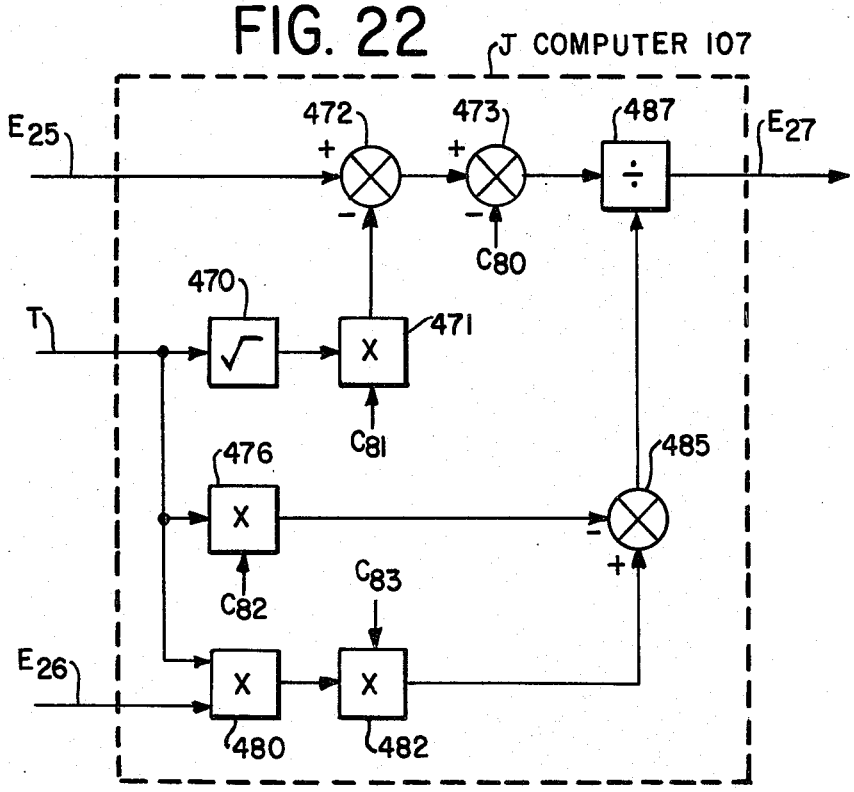

Referring now to FIG. 22, J computer 107 includes a square root circuit 470 receiving signal T and providing a signal to a multiplier 471 where it is multiplied with a direct current voltage $C_{81}$ to provide a signal to subtracting means 472. Subtracting means 472 subtracts a signal provided by multiplier 471 from signal $E_{25}$ to provide a signal corresponding to the term $\Delta VI-C_{8}$. $_{1}\sqrt{T}$ in equation 22. Subtracting means 472 provides a signal to another subtracting means 473 which subtracts a direct current voltage $C_{80}$ to provide a signal corresponding to the term $(\Delta VI-C_{80}-C_{81}\sqrt{T})$ in equation 22. A multiplier 476 multiplies signal T with a direct current voltage $C_{82}$ to provide a signal corresponding to the term $C_{82}T$ in equation 22. Another multiplier 480 multiplies signal T with signal $E_{26}$ to provide a signal to another multiplier 482 where it is multiplied with a direct current voltage $C_{83}$. Multiplier 482 provides a signal corresponding to the term $C_{83}(A)$ (T) in equation 22. Subtracting means 485 subtracts the product signal from multiplier 476 from the signal from multiplier 482 to provide a signal which is divided into the signal provided by subtracting means 473 by a divider 487. Divider 487 provides signal $E_{27}$.

Figure 23:
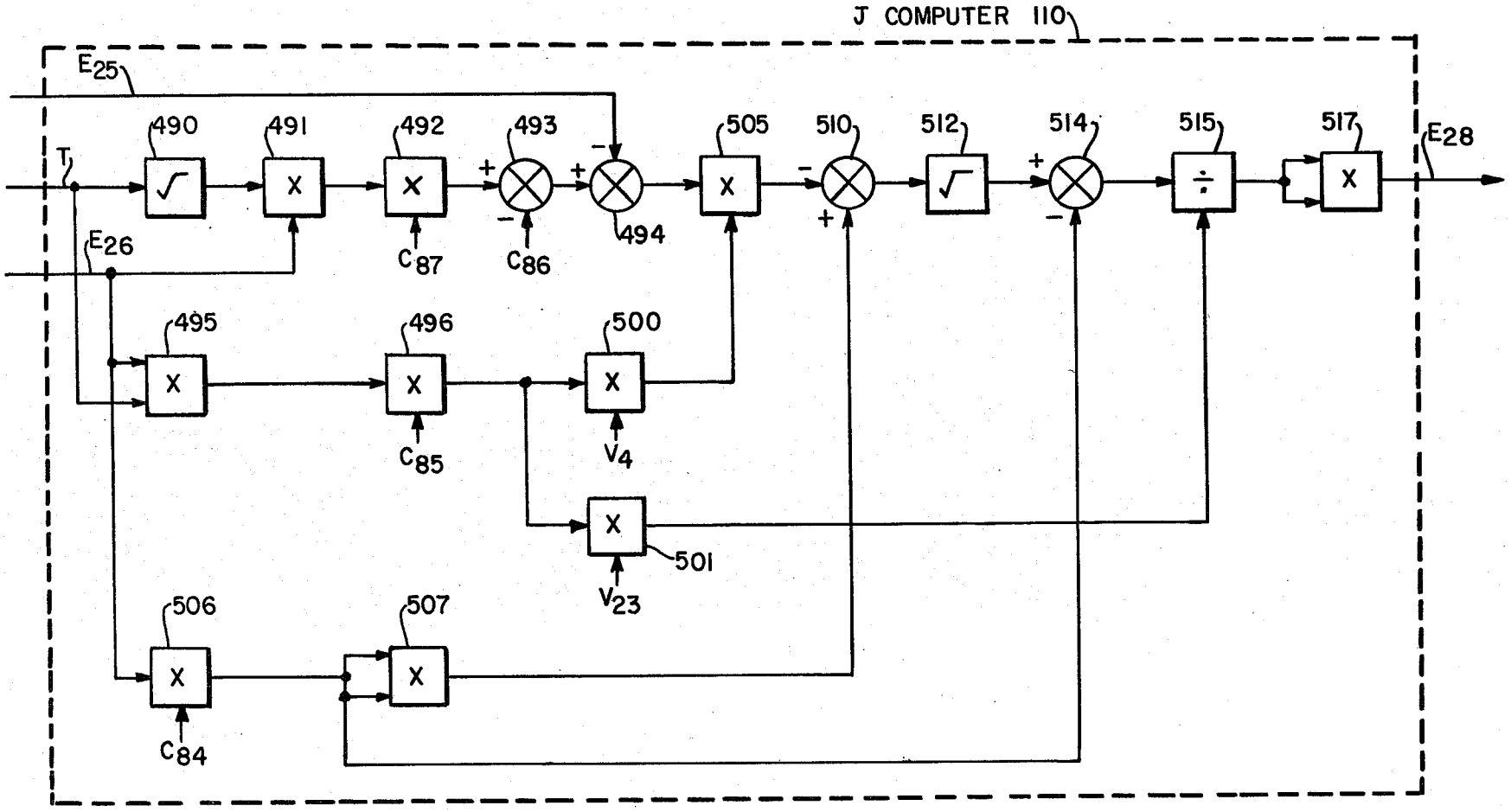

Referring to FIG. 23, J computer 110 includes a square root circuit 490 receiving signal T and providing a signal to a multiplier 491 where it is multiplied with signal $E_{26}$. Multiplier 491 provides a signal to another multiplier 492 where it is multiplied with a direct current voltage $C_{87}$ to provide a signal corresponding to the term $C_{87}(A)(T)$ in equation 23. Subtracting means 493 subtracts the direct current voltage $C_{86}$ from the signal from multiplier 492 to provide a difference signal. Subtracting means 494 subtracts signal $E_{25}$ from the difference signal provided by subtracting means 493.

A multiplier 495 multiplies signals T and $E_{26}$ to provide a signal to another multiplier 496 where it is multiplied with direct current voltage $C_{85}$. Multiplier 496 provides a signal, corresponding to the term $[C_{85}(A)$ $(T)]$ in equation 23, to multipliers 500 and 501. Multiplier 500 multiplies the signal from multiplier 496 with direct current voltage $V_4$ to provide a signal to multiplier 505 where it is multiplies with the signal from subtracting means 494. Multiplier 501 multiplies the signal from multiplier 496 with voltage $V_{23}$.

A multiplier 506 multiplies signal $E_{26}$ with a direct current voltage $C_{84}$ to provide a signal to a multiplier 507 which effectively squares the signal. Multiplier 507 provides a signal corresponding to the term $[C_{84}(A)]^2$ in equation 23. Subtracting means 510 subtracts the signal provided by multiplier 505 from the signal provided by multiplier 507 to provide a signal to square root circuit 512. Subtracting means 514 subtracts the signal provided by square root circuit 512 to develop a sum signal. A divider 515 divides the sum signal from summing means 514 with the signal from multiplier 501 to provide a signal that is squared by a multiplier 517 which provides signal $E_{28}$.

Figure 24:
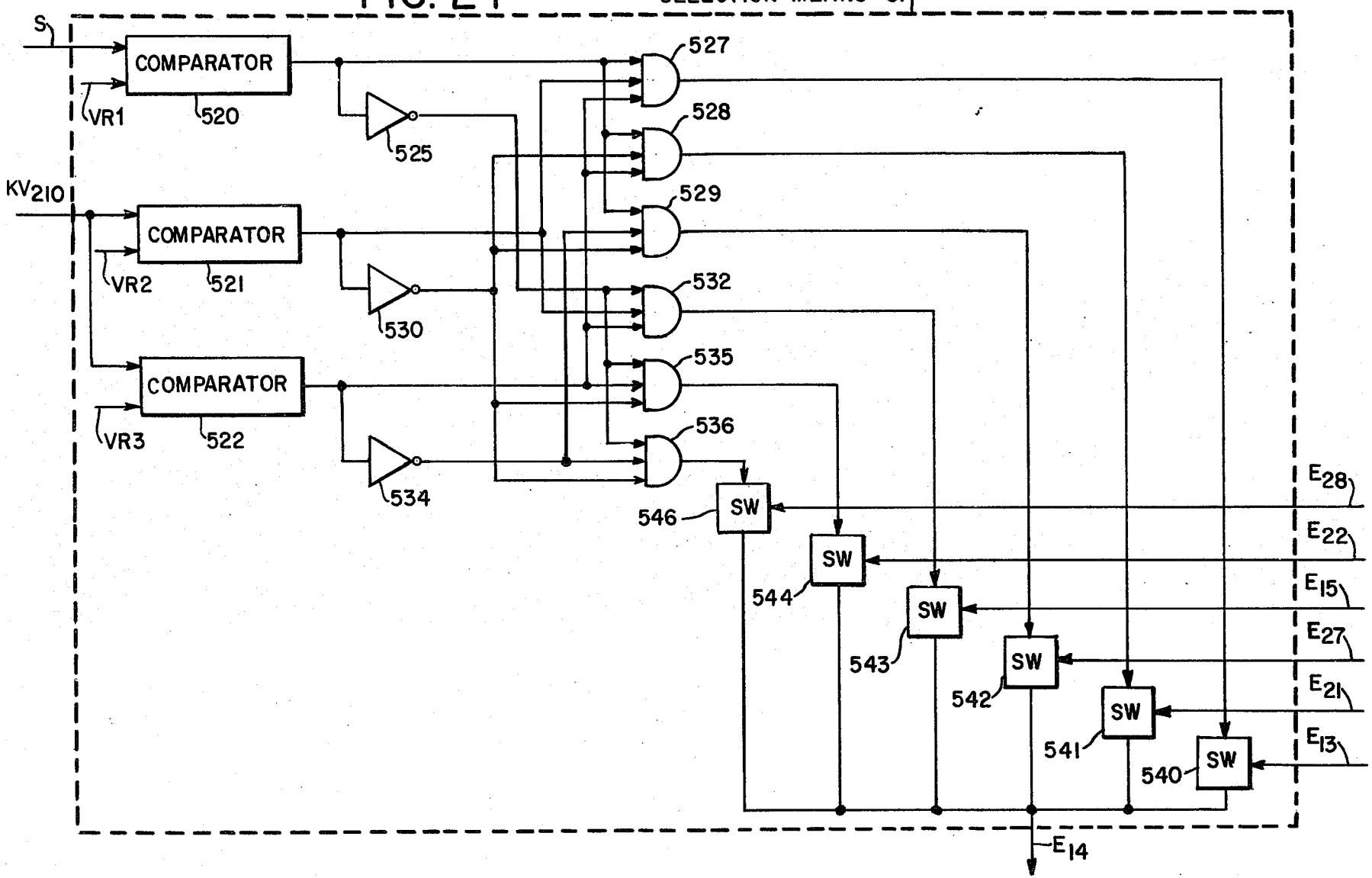

Selection means 81 in FIG. 24 includes comparators 520, 521 and 522. Comparator 520 compares signal S with a reference voltage $VR_1$ corresponding to a predetermined percent sulfur content of the charge oil, preferably about 1.0%, to determine whether the charge oil is sweet or sour. For sweet charge oil, comparator 520 provides a high level output, while for sour charge oil it provides a low level output. The output from comparator 520 is applied to an inverter 525 and to AND gates 527, 528 and 529.

Comparators 521 and 522 compare signal $KV_{210}$ with reference voltages $VR_2$ and $VR_3$ corresponding to predetermined kinetic viscosities, preferably about 7.0 and 15.0, respectively, and they determine whether the charge oil is light, medium or heavy. For light charge oil, comparators 521, 522 both provide high level outputs. For medium charge oil, comparators 521 and 522 provide a low level output and a high logic level output, respectively. For heavy charge oil, comparators 521 and 522 provide low level outputs.

Comparator 520 provide its output to an inverter 525 and to AND gates 527, 528 and 529. Comparator 521 provides its output to an inverter 530 and to AND gates 527 and 532. Comparator 522 provides its output to inverter 534 to AND gates 527, 528, 532 and 535. Inverter 525 provides its output to AND gates 532, 535 and 536. Inverter 530 provides its output to AND GATES 528, 529, 535 and 536. Inverter 534 provides its output to AND gates 529 and 536.

AND gates 527, 528, 529, 532, 535 and 536 decode the outputs of comparators 520, 521 and 522 and inverters 525, 530 and 534 to control switches 540 through 546 respectively, receiving signals $E_{13}$, $E_{21}$, $E_{27}$, $E_{15}$, $E_{22}$ and $E_{28}$, respectively. A high logic level (H) output from an AND gate renders a corresponding switch conductive to provide the signal the switch receives as signal $E_{14}$. A low logic level (L) output from the AND gate renders the switch nonconductive. The following table correlates the logic level of the AND gates to the type of charge oil.

| CHARGE | AND GATES | | | | | |
|---|---|---|---|---|---|---|
| OIL | 527 | 528 | 529 | 532 | 535 | 536 |
| LIGHT SWEET | H | L | L | L | L | L |
| LIGHT SOUR | L | L | L | H | L | L |
| MEDIUM SWEET | L | H | L | L | L | L |
| MEDIUM SOUR | L | L | L | L | H | L |
| HEAVY SWEET | L | L | H | L | L | L |
| HEAVY SOUR | L | L | L | L | L | H |

The present invention is hereinbefore described as a control system and method for controlling the operation of a furfural refining unit as a function of certain quality factors of the charge oil being provided to it. More specifically, the unit is controlled as a function of the API gravity, the flash point, the kinematic viscosity corrected to 210° F. and at 150° F., the refractive index and the sulfur content of the charge oil to achieve more accurate control of the finished product being provided by the solvent refining unit.

It would be obvious to one skilled in the art, that the charge oil flow rate may be constant and the furfural flow rate varied. For this condition, equation 13 is rewritten as:

$$24.\ SO=(CHG)(J)/100,$$

where SO is the new furfural flow rate. Of course, elements 84 and 85 would have to be re-arranged so that signal $E_{14}$ is multiplied with signal CHG and the product signal divided by voltage $V_2$ to provide signal SO to a flow rate controller controlling a valve in line 7.

We claim:

1. A control system for a furfural refining unit receiving charge oil and furfural solvent, one of which is maintained at a fixed flow rate while the flow rate of the other is controlled by the control system, treats the received charge oil with the received furfural to yield means for sampling the charge oil and providing a signal API corresponding to the API gravity of the charge oil, flash point analyzer means for sampling the charge oil and providing a signal FL corresponding to the flash point temperature of the charge oil, viscosity analyzer means for sampling the charge oil and providing signals $KV_{150}$ and $KV_{210}$ corresponding to the kinematic viscosities, corrected to 150° F. and 210° F., respectively, sulfur analyzer for sampling the charge oil and providing a signal S corresponding to the sulfur content of the charge oil, a refractometer samples the charge oil and provides a signal RI corresponding to the refractive index of the charge oil, flow rate sensing means for sensing the flow rates of the charge oil and of the furfural and providing signals CHG and SOLV, corresponding to the charge flow rate and the furfural flow rate, respectively, means for sensing the temperature of the extract-mix and providing a corresponding signal T, and control means connected to all of the analyzer means, the refractometer, and to all the sensing means for controlling the other flow rate of the charge oil and the furfural flow rates in accordance with signals API, FL, $KV_{150}$, $KV_{210}$, S, RI, CHG, T and SOLV.

2. A system as described in claim 1, in which the charge oil may be light sweet charge oil having a sulfur content equal to or less than a predetermined sulfur content and having a kinematic viscosity, corrected to a predetermined temperature, equal to or less than a first predetermined kinematic viscosity, light sour charge oil having a sulfur content greater than the predetermined sulfur content and having a kinematic viscosity, corrected to the predetermined temperature, equal to or less than the first predetermined kinematic viscosity, medium sweet charge oil having a sulfur content equal to or less than the predetermined sulfur content and having a kinematic viscosity, corrected to the predetermined temperature, greater than the first predetermined kinematic viscosity but equal to or less than a second predetermined kinematic viscosity, medium sour charge oil having a sulfur content greater than the predetermined sulfur content and having a kinematic viscosity, corrected to the predetermined temperature, greater than the first predetermined kinematic viscosity but equal to or less than the second predetermined kinematic viscosity, heavy sweet charge oil having a sulfur content equal to or less than the predetermined sulfur content and having a kinematic viscosity, corrected to the predetermined temperature, greater than the second predetermined kinematic viscosity, or heavy sour charge oil having a sulfur content greater than the predetermined sulfur content and having a kinematic viscosity, corrected to the predetermined temperature, greater than the second predetermined kinematic viscosity; and the control means includes a plurality of J signal means, each J signal means providing a signal J representative of a furfural dosage for a corresponding type of charge oil, selection means connected to the J signal means, to the viscosity analyzing means and to the sulfur analyzing means for selecting on of the J signals in accordance with one of the kinetic viscosity signals from the viscosity analyzer means and signal S and providing the selected J signal, control signal means connected to the selection means and to the flow rate sensing means for providing a control signal in accordance with the selected J signal and one of the sensed flow rate signals, and apparatus means connected to the control network means for controlling the one flow rate of the charge oil and furfural flow rates in accordance with the control signal.

3. A system as described in claim 2, in which the control means includes VI signal means connected to the viscosity analyzer means for providing a signal VI corresponding to the viscosity index of the charge oil in accordance with kinematic viscosity signals $KV_{150}$ and $KV_{210}$; $SUS_{210}$ signal means connected to the viscosity analyzer means for providing a signal $SUS_{210}$ corresponding to the charge oil viscosity in Saybolt Universal Seconds corrected to 210° F; W signal means connected to the viscosity analyzer means, to the gravity analyzer means and to the sulfur analyzer means for providing a signal W corresponding to the wax content of the charge oil in accordance with signals $KV_{210}$, API and S, first A signal means connected to the viscosity analyzer means, to the sulfur analyzer means, to the flash point temperature analyzer means, to the gravity analyzer means and to the VI signal means for providing a first signal A corresponding to an interim factor A in accordance with signals $KV_{210}$, S, FL, API and VI; second A signal means connected to the viscosity analyzer means, to the gravity analyzer means and to the flash point temperature analyzer means for providing a second signal A corresponding to an interim factor A in accordance with signals $KV_{210}$, API and FL; third A signal means connected to the gravity analyzer means, to the viscosity analyzer means, to the sulfur analyzer means, to the flash point temperature analyzer means and to the VI signal means for providing a third signal A corresponding to an interim factor A in accordance with signals $KV_{210}$, S, API, VI and FL; first ΔVI signal means connected to the viscosity analyzer means, to the gravity analyzer means, to the flash point temperature analyzer means, to the VI signal means and to the $SUS_{210}$ signal means and receiving a direct current voltage $VI_{RP}$ corresponding to the viscosity index of the refined oil at the predetermined temperature for providing a first signal ΔVI in accordance with signals $KV_{210}$, API, FL, VI and $SUS_{210}$ and voltage $VI_{RP}$; second ΔVI signal means connected to the gravity analyzer means, to the flash point temperature analyzer means, to the refractometer, to the VI signal means, to the W signal means and to the $SUS_{210}$ signal means and receiving voltage $VI_{RP}$ for providing a second signal ΔVI corresponding to the change in viscosity index in accordance with signals VI, W, API, FL, RI, $SUS_{210}$ and voltage $VI_{RP}$; third ΔVI signal means connected to the viscosity analyzer means, to the gravity analyzer means, to the flash point temperature analyzer means, to the VI signal means, the W signal means and the $SUS_{210}$ signal means and receiving voltage $VI_{RP}$ for providing a third signal ΔVI corresponding to the change in viscosity index in accordance with signals $KV_{210}$, API, VI, FL, W and $SUS_{210}$ and voltage $VI_{RP}$; and the plurality of J signal means includes first J signal means connected to the first ΔVI signal means, to the first A signal means, to the temperature sensing means and to the selection means for providing a first J signal to the selection means corresponding to a furfural dosage for light sweet charge oil in accordance with the first ΔVI signal, the first signal A and signal T, second J signal means connected to the first ΔVI signal means, to the first A signal means, to the temperature sensing means and to the selection means for providing a second J signal to the selection means corresponding to the furfural dosage for light sour charge oil in accordance with the first signal ΔVI, the first signal A and signal T, third J signal means connected to the second ΔVI signal means, to the second A signal means, to the temperature sensing means and to the selection means for providing a third J signal to the selection means corresponding to the furfural dosage for medium sweet charge oil in accordance with the second signal ΔVI, the second signal A, and signal T, fourth J signal means connected to the second ΔVI signal means, to the temperature sensing means and to the selection means for providing a fourth J signal to the selection means corresponding to the furfural dosage for medium sour charge oil in accordance with the second signal ΔVI and signal T, fifth J signal means connected to the third ΔVI signal means, to the third A signal means, to the temperature sensing means and to the selection means for providing a fifth signal J to the selection means corresponding to the furfural dosage for heavy sweet charge oil in accordance with the third signal ΔVI, the third signal A and signal T, and sixth J signal means connected to the third ΔVI signal means, to the third A signal means, to the temperature sensing means and to the selection means for providing a sixth J signal to the selection means in accordance with the third signal ΔVI, the third signal A and signal T.

4. A system as described in claim 3 in which the $SUS_{210}$ signal means includes SUS signal means connected to the viscosity analyzer means, and receiving direct current voltages $C_5$ through $C_{12}$ for providing a signal SUS corresponding to an interim factor SUS in accordance with signal $KV_{210}$, voltages $C_5$ through $C_{12}$ and the following equation:

$$SUS=C_5(KV_{210})+[C_6+C_7(KV_{210})]/[C_8+C_9(KV_{210})+C_{10}(KV_{210})^2+C_{11}(KV_{210})^3](C_{12}),$$

where $C_5$ through $C_{12}$ are constants; and $SUS_{210}$ network means connected to the SUS signal means and to all the ΔVI signal means and receiving direct current voltages $C_{13}$ through $C_{16}$ for providing signal $SUS_{210}$ to all the ΔVI signal means in accordance with signal SUS, voltages $C_{13}$ through $C_{16}$ and the following equation:

$$SUS_{210}=[C_{13}+C_{14}(C_{15}-C_{16})]SUS,$$

where $C_{13}$ through $C_{16}$ are constants.

5. A system as described in claim 4 in which the W signal means further receives direct current voltages $C_{43}$ through $C_{49}$ and provides signal W in accordance with signals API, $KV_{210}$ and S, voltages $C_{43}$ through $C_{49}$, and the following equation:

$$W=C_{43}-C_{44}API+C_{45}/KV_{210}-C_{46}S+C_{47}(API)^2-C_{48}API/KV_{210}+C_{49}(S)(API)_5$$

where $C_{43}$ through $C_{49}$ are constants.

6. A system as described in claim 5 in which the VI signal means includes K signal means receiving direct current voltages $C_2$, $C_3$, $C_4$ and $T_{150}$ for providing a signal $K_{150}$ corresponding to the kinematic viscosity of the charge oil corrected to 150° F. in accordance with voltages $C_2$, $C_3$, $C_4$ and $T_{150}$, and the following equation:

$$K_{150}=[C_2-ln(T_{150}+C_3)]/C_4,$$

where $C_2$ through $C_4$ are constants, and $T_{150}$ corresponds to a temperature of 150° F.; $H_{150}$ signal means connected to the viscosity analyzer means and receiving a direct current voltage $C_1$ for providing a signal $H_{150}$ corresponding to a viscosity H value for 150° F. in accordance with signal $KV_{150}$ and voltage $C_1$ in the following equation:

$$H_{150}=lnln(KV_{150}+C_1),$$

where $C_1$ is a constant; $H_{210}$ signal means connected to the viscosity analyzer means and receiving voltage $C_1$ for providing signal $H_{210}$ corresponding to a viscosity H value for 210° F. in accordance with signal $KV_{210}$, voltage $C_1$ and the following equation:

$$H_{210}=lnln(KV_{210}+C_1),$$

$H_{100}$ signal means connected to the K signal means, to the $H_{150}$ signal means and the $H_{210}$ signal means for providing a signal $H_{100}$ corresponding to a viscosity H value for 100° F., in accordance with signals $H_{150}$, $H_{210}$ and $K_{150}$ and the following equation:

$$H_{100}=H_{210}+(H_{150}-H_{210})/K_{150}$$

$KV_{100}$ signal means connected to the $H_{100}$ signal means and receiving voltage $C_1$ for providing a signal $KV_{100}$ corresponding to a kinematic viscosity for the charge oil corrected to 100° F. in accordance with signal $H_{100}$, voltage $C_1$, and the following equation:

$$KV_{100}=exp[exp(H_{100})]-C_1,$$

and VI memory means connected to the $KV_{100}$ signal means and to the viscosity analyzer means having a plurality of signals stored therein, corresponding to different viscosity index and controlled by signals $KV_{100}$ and $KV_{210}$ to select a stored signal and providing the selected stored signal as signal VI.

7. A system as described in claim 6 in which the first A signal means also receives direct current voltages $C_{24}$ through $C_{31}$ and provides the first signal A in accordance with signals S, $KV_{210}$, API, VI and FL, voltages $C_{24}$ through $C_{31}$ and the following equation:

$$A=C_{24}-C_{25}(S)-C_{26}(S)^2+C_{27}(KV_{210})(API)-C_{28}(KV_{210})(VI)-C_{29}(FL)(API)+C_{30}(FL)(S)+C_{31}(FL)(VI),$$

where $C_{24}$ through $C_{31}$ are constants.

8. A system as described in claim 7 in which the second A signal means also receives direct current voltages $C_{55}$ through $C_{56}$ and provides the second A signal in accordance with signals API, FL, and $KV_{210}$, voltages $C_{55}$ through $C_{57}$ and the following equation:

$$A=C_{55}-C_{50}(API)+C_{57}(FL)(KV_{210}),$$

where $C_{55}$ through $C_{57}$ are constants.

9. A system as described in claim 10 in which the third A signal means also receives direct current voltages $C_{74}$ through $C_{79}$ and provides the third signal A in accordance with signals $KV_{210}$, S, FL, and API, voltages $C_{74}$ through $C_{79}$, and the following equation:

$$A=C_{74}-C_{75}(KV_{210})^2+C_{76}(S)+C_{77}(FL)^2-C_{78}(FL)(API)-C_{79}(KV_{210})(S),$$

where $C_{74}$ through $C_{79}$ are constants.

10. A system as described in claim 9 in which the first ΔVI signal means includes $VI_{DWC_o}$ signal means connected to the flash point temperature analyzer means, to the viscosity analyzer means and to the gravity analyzer means, and to the VI signal means, and receiving direct current voltages $C_{17}$ through $C_{20}$ for providing a first signal $VI_{DWC_o}$ corresponding to the viscosity index of the dewaxed charge oil for 0° F. in accordance with signals FL, VI, $KV_{210}$ and API, voltages $C_{17}$ through $C_{20}$ and the following equation:

$$VI_{DWC_o}=C_{17}-C_{18}(FL)+C_{19}(VI)+C_{20}(KV_{210})(API),$$

where $C_{17}$ through $C_{20}$ are constants; $VI_{DWC_p}$ signal means connected to the first $VI_{DWC_o}$ signal means and to the $SUS_{210}$ signal means, and receiving direct current voltages $C_{21}$ through $C_{23}$ and Pour, providing a signal $VI_{DWC_p}$ corresponding to the viscosity index of the dewaxed charge oil at the predetermined temperature, in accordance with signals $VI_{DWC_o}$ and $SUS_{210}$, voltages $C_{21}$ through $C_{23}$ and Pour, and the following equation:

$$VI_{DWC_p}=VI_{DWC_o}+(POUR)[C_{21}-C_{22}lnSUS_{210}+C_{23}(lnSUS_{210})^2],$$

where Pour is the pour point of the dewaxed product and $C_{21}$ through $C_{23}$ are constants; subtracting means connected to the first $VI_{DWC_p}$ means and to the first and second J signal means and receiving voltage $VI_{RP}$ for kinematic voltage $VI_{RP}$ from signal $VI_{DWC_p}$ to provide the first ΔVI signal to the first and second J signal means.

11. A system as described in claim 10 in which the second ΔVI signal means includes a second $VI_{DWC_o}$ signal means connected to the gravity analyzer means, the flash point temperature analyzer means, the refractometer, the VI signal means and the W signal means, and receives direct current voltages $C_{50}$ through $C_{54}$ and provides a second $VI_{DWC_o}$ signal in accordance with signals RI, VI, FL, W and API, voltages $C_{50}$ through $C_{54}$ and the following equation:

$$VI_{DWC_o}=C_{50}-C_{51}RI+C_{52}(RI)(VI)+c_{53}(FL)(API)-C_{54}(W)(VI),$$

where $C_{50}$ through $C_{54}$ are constants; a second $VI_{DWC_p}$ signal means connected to the second $VI_{DWC_o}$ signal means and to the $SUS_{210}$ signal means for providing a second $VI_{DWC_p}$ signal in accordance with signals $SUS_{210}$ and $VI_{DWC_p}$, voltages $C_{21}$ through $C_{23}$ and Pour, and the following equation:

$$VI_{DWC_p}=VI_{DWC_o}+(POUR)[C_{21}-C_{22}lnSUS_{210}+C_{23}(lnSUS_{210})^2],$$

and second subtracting means connected to the third and fourth J signal means and to the second $VI_{DWC_p}$ signal means and receiving voltage $VI_{RP}$ for subtracting signal $VI_{DWC_p}$ from voltage $VI_{RP}$ to provide the second ΔVI signal to the third and fourth J signal means.

12. A system as described in claim 11 in which the third ΔVI signal means includes a third $VI_{DWC_o}$ signal means connected to the viscosity analyzer means, to the gravity analyzer means, to the flash point temperature analyzer means, to the VI signal means, to the W signal means and receiving direct current voltages $C_{67}$ through $C_{73}$ for providing a third signal $VI_{DWC_o}$ in accordance with signals $KV_{210}$, VI, API, FL and W, voltages $C_{67}$ through $C_{73}$, and the following equation:

$$VI_{DWC_o}=-C_{67}+C_{68}(KV_{210})^2+C_{69}(VI)-C_{70}(API)(VI)+C_{71}(API)^2+C_{72}(FL)(VI)-C_{73}(W)(KV_{210}),$$

where $C_{67}$ through $C_{73}$ are constants; a third $VI_{DWC_p}$ signal means connected to the third $VI_{DWC_o}$ signal means and to the $SUS_{210}$ signal means, and receiving direct current voltages $C_{21}$ through $C_{23}$ and Pour, for providing a third signal $VI_{DWC_p}$ in accordance with signal $VI_{DWC_o}$ and $SUS_{210}$, voltages $C_{21}$ through $C_{23}$, and Pour, and the following equation:

$$VI_{DWC_p}=VI_{DWC_o}+(POUR)[C_{21}-C_{22}lnSUS_{210}+C_{23}(lnSUS_{210})^2],$$

and third subtracting means connected to the third $VI_{DWC_p}$ signal means and to the fifth and sixth J signal means and receiving direct voltage $VI_{RP}$ for subtracting the third signal $VI_{DWC_p}$ from voltage $VI_{RP}$ to provide the third ΔVI signal to the fifth and sixth J signal means.

13. A system as described in claim 12 in which flow rate of the charge oil is controlled and the flow of the furfural is maintained at a constant rate and the control signal means receives signal SOLV from the flow rate sensing means, the selected J signal from the selection means and a direct current voltage corresponding to a value of 100 and provides a signal C to the apparatus means corresponding to a new charge oil flow rate in accordance with the selected J signal, signal SOLV and the received voltage and the following equation:

$$C=(SOLV)(100)/J,$$

so as to cause the apparatus means to change the charge oil flow to the new flow rate.

14. A system as described in claim 12 in which the controlled flow rate is the furfural flow rate and the flow of the charge oil is maintained constant, and the control signal means is connected to the sensing means, to the selection means and receives a direct current voltage corresponding to the value of 100 for providing a signal SO corresponding to a new furfural flow rate in accordance with signals CHG and the selected J signal and the received voltage, and the following equation:

$$SO=(CHG)(J)/100,$$

so as to cause the furfural flow to change to the new flow rate.

15. A control system as described in claim 12 in which the first J signal means also receives direct current voltages $C_{32}$ through $C_{39}$ and provides the first J signal in accordance with signal T, the first A signal and the first ΔVI signal, voltages $C_{32}$ through $C_{39}$ and the following equation:

$$J=\{\{C_{32}-C_{33}A+\{[C_{33}A-C_{32}]^2-4[C_{34}-C_{35}A][-C_{36}+C_{37}\sqrt{T}-C_{38}(A)(\sqrt{T})-\Delta VI]\}^{1/2}\}/2[C_{34}-C_{35}(A)]\}^2,$$

where $C_{32}$ through $C_{39}$ are constants; the second J signal means also receives direct current voltages $C_{39}$ through $C_{42}$ and provides the second J signal in accordance with signal T, and the first ΔVI signal, voltages $C_{39}$ through $C_{42}$ and the following equation:

$$J=\{\{-C_{39}+\{(C_{39})^2-4(C_{40})(T)[-C_{41}+C_{42}T-\Delta VI]\}^{1/2}\}/2(C_{40}T)\}^2,$$

where $C_{39}$ through $C_{42}$ are constants; the third J signal means also receives direct current voltages $C_{58}$ through $C_{61}$ and provides the third J signal in accordance with signal T, the second A signal and the second ΔVI signal, voltages $C_{58}$ through $C_{61}$ and the following equation:

$$J=\{\{-C_{58}A+\{(C_{58}A)^2-4C_{59}A(C_{60}+C_{61}\sqrt{T}-\Delta VI)\}^{1/2}\}/2C_{59}A\}^2,$$

where $C_{58}$ through $C_{61}$ are constants; the fourth J signal means also receives direct current voltages $C_{62}$ through $C_{66}$ and provides the fourth J signal in accordance with signal T, the second A signal and the second ΔVI signal, voltages $C_{62}$ through $C_{66}$ and the following equation:

$$J=\{\{-C_{62}+\{(C_{62})^2-4(-C_{63})[C_{64}\sqrt{T}+C_{65}(\sqrt{T})(A)-C_{66}-\Delta VI]\}^{1/2}\}/2C_{63}\}^2,$$

where $C_{62}$ through $C_{66}$ are constants; the first J signal means also receives direct current voltages $C_{80}$ through $C_{83}$ and provides the fifth J signal in accordance with signal T, the third A signal and the third ΔVI signal, voltages $C_{80}$ through $C_{83}$ and the following equation:

$$J=(\Delta VI-C_{80}-C_{81}\sqrt{T})/[-C_{82}T+C_{83}(A)(T)],$$

where $C_{80}$ through $C_{83}$ are constants; the sixth J signal means also receives direct current voltages $C_{84}$ through $C_{87}$ and provides the sixth J signal in accordance with signal T, the third A signal and the third ΔVI signal, voltages $C_{81}$ through $C_{87}$ and the following equation:

$$J=\{\{-C_{84}A+\{[C_{84}(A)]^2-4[C_{85}(A)(T)][-C_{86}+C_{87}(A)(\sqrt{T})-\Delta VI]\}^{1/2}\}/2[C_{85}(A)(T)]\}^2,$$

where $C_{84}$ through $C_{87}$ are constants.

* * * * *

UNITED STATES PATENT AND TRADEMARK OFFICE

CERTIFICATE OF CORRECTION

PATENT NO. : 4,162,197

DATED : July 24, 1979

INVENTOR(S) : A. SEQUEIRA, JR.; J. D. BAGNARD; F. L. BARGER

It is certified that error appears in the above-identified patent and that said Letters Patent are hereby corrected as shown below:

Column 15, lines 57 and 58, "furfural to yield means for sampling" should read --furfural to yield extract mix and raffinate, comprising gravity analyzer means for sampling--

Column 18, line 41, "$(API)_s$" should read --(API),--

Column 18, line 51, "$In(T_{150}$" should read --$ln(T_{150}$--

Column 19, line 38, "$C_{50}(API)$" should read --$C_{56}(API)$--

Column 20, line 32, "$VI_{DWC_p}$" should read --$VI_{DWC_0}$--

Signed and Sealed this

Twenty-eighth Day of October 1980

[SEAL]

Attest:

SIDNEY A. DIAMOND

Attesting Officer

Commissioner of Patents and Trademarks